US008905734B2

(12) United States Patent
Shin et al.

(10) Patent No.: US 8,905,734 B2
(45) Date of Patent: Dec. 9, 2014

(54) COMPRESSOR

(75) Inventors: Jinung Shin, Seoul (KR); Seseok Seol, Seoul (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 13/338,822

(22) Filed: Dec. 28, 2011

(65) Prior Publication Data

US 2012/0171066 A1 Jul. 5, 2012

(30) Foreign Application Priority Data

Dec. 29, 2010 (KR) ..... 10-2010-0138186

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/00*** | (2006.01) |
| ***F04C 15/00*** | (2006.01) |
| ***F04C 29/00*** | (2006.01) |
| ***F01C 21/10*** | (2006.01) |
| ***F04C 18/32*** | (2006.01) |
| ***F04C 23/00*** | (2006.01) |
| *F04C 29/02* | (2006.01) |
| *F04C 29/06* | (2006.01) |

(52) U.S. Cl.

CPC ..... *F01C 21/10* (2013.01); *F04C 29/025* (2013.01); *F04C 18/322* (2013.01); *F04C 2240/40* (2013.01); *F04C 29/06* (2013.01); *F04C 23/008* (2013.01); *F04C 2270/12* (2013.01); *F04C 2240/804* (2013.01)

USPC ..... 418/55.1; 418/55.5; 418/58; 418/60; 418/270

(58) Field of Classification Search

USPC ..... 418/63, 66, 91–94, 102–103, 228–229, 418/183, 173–177, 270, DIG. 1, 55.1, 55.5; 417/356–357, 410.1, 902; 184/6.16, 184/6.18

See application file for complete search history.

(56) References Cited

U.S. PATENT DOCUMENTS

| | | | | |
|---|---|---|---|---|
| 2,122,462 A | | 7/1938 | Fricke | 230/140 |
| 2,415,011 A | * | 1/1947 | Hubacker | 417/256 |

(Continued)

FOREIGN PATENT DOCUMENTS

| | | |
|---|---|---|
| CN | 101135309 | 3/2008 |
| EP | 0 526 145 A2 | 2/1993 |

(Continued)

OTHER PUBLICATIONS

International Search Report and Written Opinion dated May 1, 2012. (PCT/KR2011/010108).

(Continued)

*Primary Examiner* — Kenneth Bomberg
*Assistant Examiner* — Deming Wan
(74) *Attorney, Agent, or Firm* — Ked & Associates LLP

(57) ABSTRACT

A compressor is provided having an accumulator that may form an accumulating chamber at an internal space of a shell, thereby reducing a size of the compressor, and simplifying an assembly process. A stationary shaft having a refrigerant suction passage may be directly connected to the accumulator to prevent leakage of refrigerant. Further, a center of gravity of the accumulator may correspond to a center of gravity of the compressor to reduce vibration noise of the compressor caused by the accumulator. Furthermore, an oil collecting plate may be installed at an upper end of an upper bearing to supply oil between a vein and vein slot, thereby preventing compression loss. Also, an installation area of the compressor including the accumulator may be minimized to enhance design flexibility of an outdoor device employing the compressor and minimize interference with other components, thereby facilitating installation of the outdoor device.

16 Claims, 17 Drawing Sheets

(56) References Cited

U.S. PATENT DOCUMENTS

| | | | | |
|---|---|---|---|---|
| 2,420,124 | A | 5/1947 | Coulson | |
| 2,440,593 | A * | 4/1948 | Miller | 418/88 |
| 3,153,334 | A | 10/1964 | Vutz | |
| 4,624,630 | A * | 11/1986 | Hirahara et al. | 418/63 |
| 4,826,408 | A | 5/1989 | Inoue et al. | |
| 5,261,800 | A | 11/1993 | Sakae | |
| 5,295,788 | A | 3/1994 | Tajima et al. | |
| 5,374,171 | A | 12/1994 | Cooksey | |
| 5,542,831 | A | 8/1996 | Scarfone | |
| 6,213,732 | B1 | 4/2001 | Fujio | |
| 6,592,346 | B2 | 7/2003 | Bushnell | |
| 6,817,490 | B2 | 11/2004 | Petit | |
| 6,824,367 | B2 * | 11/2004 | Matsumoto et al. | 418/1 |
| 7,344,367 | B2 | 3/2008 | Manole | |
| 7,361,004 | B2 * | 4/2008 | Hwang et al. | 418/59 |
| 7,607,904 | B2 * | 10/2009 | Masuda | 418/62 |
| 2003/0072664 | A1 | 4/2003 | Bushnell | 418/63 |
| 2005/0031465 | A1 | 2/2005 | Dreiman et al. | |
| 2005/0201884 | A1 | 9/2005 | Dreiman | |
| 2006/0127256 | A1 | 6/2006 | Hwang et al. | 418/29 |
| 2006/0159570 | A1 | 7/2006 | Manole | 471/440 |
| 2009/0155111 | A1 | 6/2009 | Okaichi et al. | |
| 2010/0092322 | A1 | 4/2010 | Furusho et al. | |
| 2010/0322796 | A1 * | 12/2010 | Ko | 417/415 |

FOREIGN PATENT DOCUMENTS

| | | | |
|---|---|---|---|
| EP | 1 657 444 | A1 | 5/2006 |
| JP | 61-187591 | | 8/1986 |
| JP | 62-284985 | | 12/1987 |
| JP | 63-186988 | | 8/1988 |
| JP | 2000-283074 | | 10/2000 |
| JP | 2002-221156 | | 8/2002 |
| KR | 10-1998-043393 | | 9/1998 |
| KR | 10-1999-0012573 | | 2/1999 |
| KR | 10-0230999 | | 11/1999 |
| KR | 10-1999-0084586 | | 12/1999 |
| KR | 10-2000-0033611 | | 6/2000 |
| KR | 20-2001-0002267 | | 10/2001 |
| KR | 10-2010-0010441 | | 2/2010 |
| WO | WO 2010/010994 | | 1/2010 |
| WO | WO 2010/010996 | | 1/2010 |

OTHER PUBLICATIONS

International Search Report and Written Opinion dated May 1, 2012. (PCT/KR2011/010110).

International Search Report and Written Opinion dated May 1, 2012. (PCT/KR2011/010166).

International Search Report and Written Opinion dated May 1, 2012. (PCT/KR2011/010111).

U.S. Office Action issued in U.S. Appl. No. 13/338,737 dated Aug. 28, 2013.

U.S. Office Action issued in U.S. Appl. No. 13/338,778 dated Sep. 11, 2013.

Chinese Office Action dated Feb. 7, 2014. (translation).

European. Search Report dated Apr. 14, 2014.

European Search Report dated Apr. 14, 2014.

U.S. Office Action issued in U.S. Appl. No. 13/338,737 dated Apr. 24, 2014.

U.S. Office Action issued in U.S. Appl. No. 13/338,605 dated May 9, 20124.

U.S. Office Action issued in U.S. Appl. No. 13/338,480 dated May 13, 20124.

U.S. Office Action issued in U.S. Appl. No. 13/338,480 dated Dec. 2, 2013.

U.S. Office Action issued in U.S. Appl. No. 13/338,737 dated Dec. 31, 2013.

U.S. Office Action issued in U.S. Appl. No. 13/338,778 dated Jan. 15, 2014.

European Search Report issued in Application No. 11852747.2 dated Jun. 11, 2014.

Notice of Allowance dated Jul. 21, 2014, issued in U.S. Appl. No. 13/338,737.

Notice of Allowance dated Sep. 4, 2014, issued in U.S. Appl. No. 13/338,480.

European Search Report dated Sep. 8, 2014, issued in Application No. 11853555.8.

Office Action dated Oct. 1, 2014, issued in U.S. Appl. No. 13/338,778.

Chinese Office Action dated Sep. 19, 2014. (translation).

* cited by examiner

COMPRESSOR

CROSS-REFERENCE TO RELATED APPLICATION(S)

The present application claims priority Korean Application No. 10-2010-0138186, filed in Korea on Dec. 29, 2010, which is herein expressly incorporated by reference in its entirety.

BACKGROUND

1. Field

A compressor is disclosed herein.

2. Background

Compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
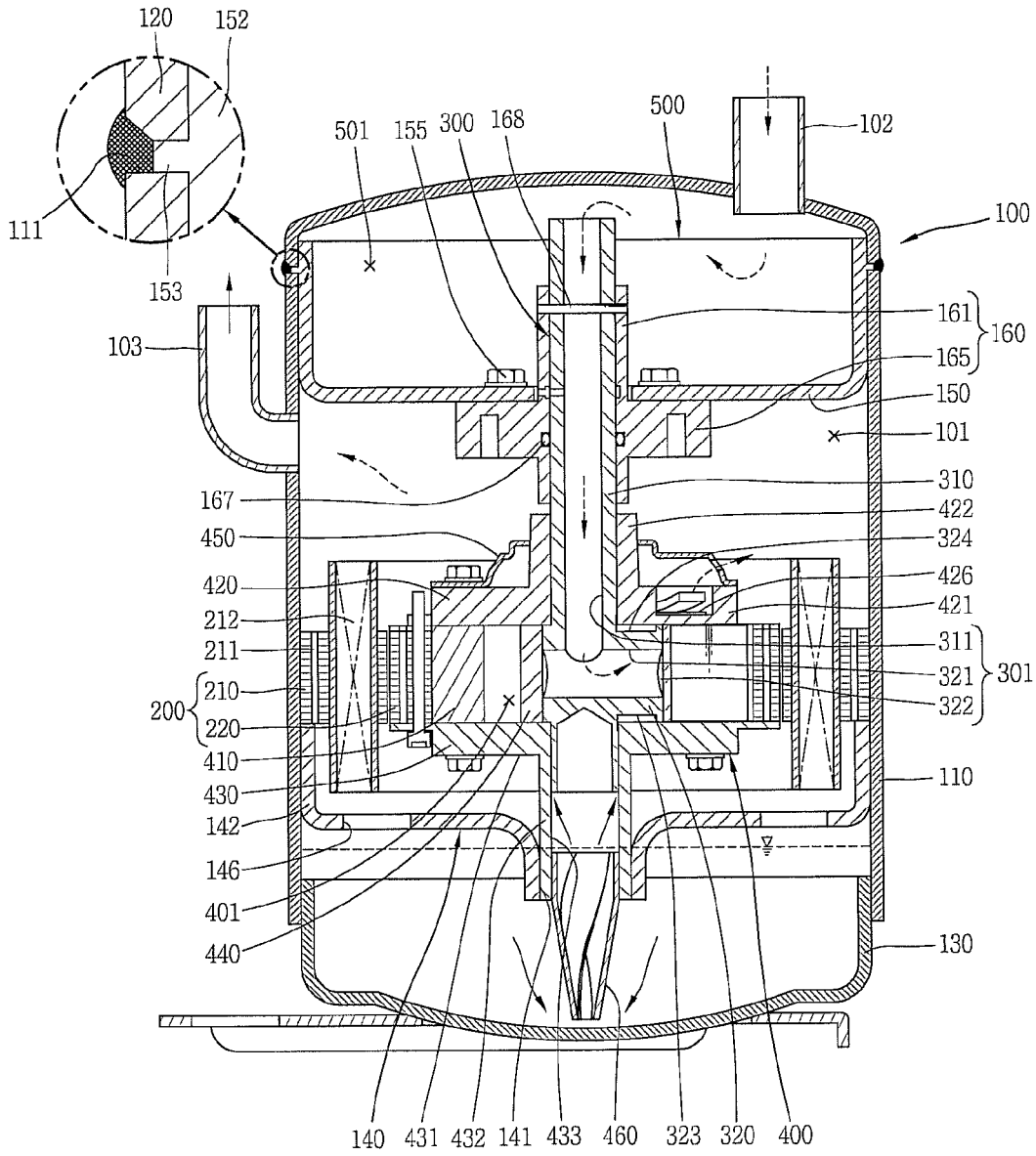
FIG. 1 is a cross-sectional view of a compressor according to an embodiment.

Hereinafter, a compressor according to embodiments will be described in detail with reference to the accompanying drawings. Where possible, like reference numerals have been used to indicate like elements.

In general, a compressor, which may be referred to as a hermetic compressor, may be provided with a drive motor that generates a driving force installed in an internal space of a sealed shell and a compression unit or device operated in combination with the drive motor to compress refrigerant. Compressors may be divided into reciprocating compressors, scroll compressors, rotary compressors, and oscillating compressors according to a method of compressing a refrigerant. The reciprocating, scroll, and rotary type compressors use a rotational force of the drive motor; however, the oscillating type compressor uses a reciprocating motion of the drive motor.

In the above-described compressors, a drive motor of the hermetic compressor using rotational force may be provided with a crank shaft that transfers the rotational force of the drive motor to a compression device. For instance, the drive motor of the rotary type compressor (hereinafter, "rotary compressor") may include a stator fixed to the shell, a rotor inserted into the stator with a predetermined gap therebetween and rotated in accordance with an interaction with the stator, and a crank shaft coupled with the rotor to transfer the rotational force of the drive motor to the compression device while being rotated together with the rotator. In addition, the compression device may include a cylinder that forms a compression space, a vane that divides the compression space of the cylinder into a suction chamber and a discharge chamber, and a plurality of bearing members that forms the compression space together with the cylinder while supporting the vane. The plurality of bearing members may be disposed at one side of the drive motor or disposed at both sides thereof, respectively, to provide support in both axial and radial directions, such that the crank shaft may be rotated with respect to the cylinder.

Further, an accumulator, which may be connected to a suction port of the cylinder to divide refrigerant inhaled into the suction port into gas refrigerant and liquid refrigerant and inhale only the gas refrigerant into a compression space, may be installed at a side of the shell. The capacity of the accumulator may be determined according to a capacity of the compressor or cooling system. Further, the accumulator may be fixed by, for example, a band or a clamp at an outer portion of the shell, and may communicate with a suction port of the cylinder through a L-shaped suction pipe, which may be fixed to the shell.

However, in the case of the above-described rotary compressor, the accumulator may be installed at an outer portion of the shell. Thus, a size of the compressor including the accumulator may be increased, thereby increasing a size of an electrical product employing the compressor.

Further, in such a rotary compressor, the accumulator may be connected to a separate suction pipe outside of the shell, and thus, assembly of the shell and accumulator may be separated from each other, complicating an assembly process while increasing a number of assembly processes. Moreover, a number of connecting portions may be increased, as both sides of the accumulator may be connected to the shell through refrigerant pipes, respectively, thereby increasing the possibility of refrigerant leakage.

Furthermore, in such a rotary compressor, an area occupied by the compressor may be increased, because the accumulator is installed outside of the shell, thereby limiting design flexibility when the compressor is mounted, for example, on or to an outdoor device of a cooling cycle apparatus. Also, in such a rotary compressor, the accumulator may be eccentrically disposed with respect to a center of gravity of the entire compressor including the accumulator, and thus, an eccentric load due to the accumulator may occur, as the accumulator is installed outside of the shell, thereby increasing vibration noise of the compressor.

Also, in such a rotary compressor, compressor vibration may be increased while increasing an eccentric load of the crank shaft when an eccentric amount of the eccentric portion is too large as the crank shaft is rotated, and the compressor capacity may be reduced when the eccentric load of the crank shaft is small.

Further, in such a rotary compressor, when an oil amount remaining at a bottom surface of the shell is lower than a bottom surface of the cylinder due to a reason, for example, that oil is excessively exhausted from the shell, oil cannot be supplied between the vane slot and the vane, and thus, the vane may not be efficiently slide within the vane slot. Due to this, the vane cannot be closely adhered to the rolling piston, thereby incurring compression loss.

Also, in such a rotary compressor, a drive motor and a compression device installed at an inner portion of the shell may be installed at both sides of the crank shaft, thereby increasing a total height of the compressor. Due to this, the compressor cannot be installed at a center of the outdoor device, but rather, is installed biased to one side, taking into consideration interference with other components, when the compressor is mounted, for example, in an outdoor device of a cooling cycle apparatus. Therefore, a center of gravity of the outdoor device may be eccentrically located to a side at which the compressor is installed, thereby causing inconvenience or spatial restrictions when moving or installing the outdoor device, as well as increasing vibration noise of the entire outdoor device.

Figure 2:
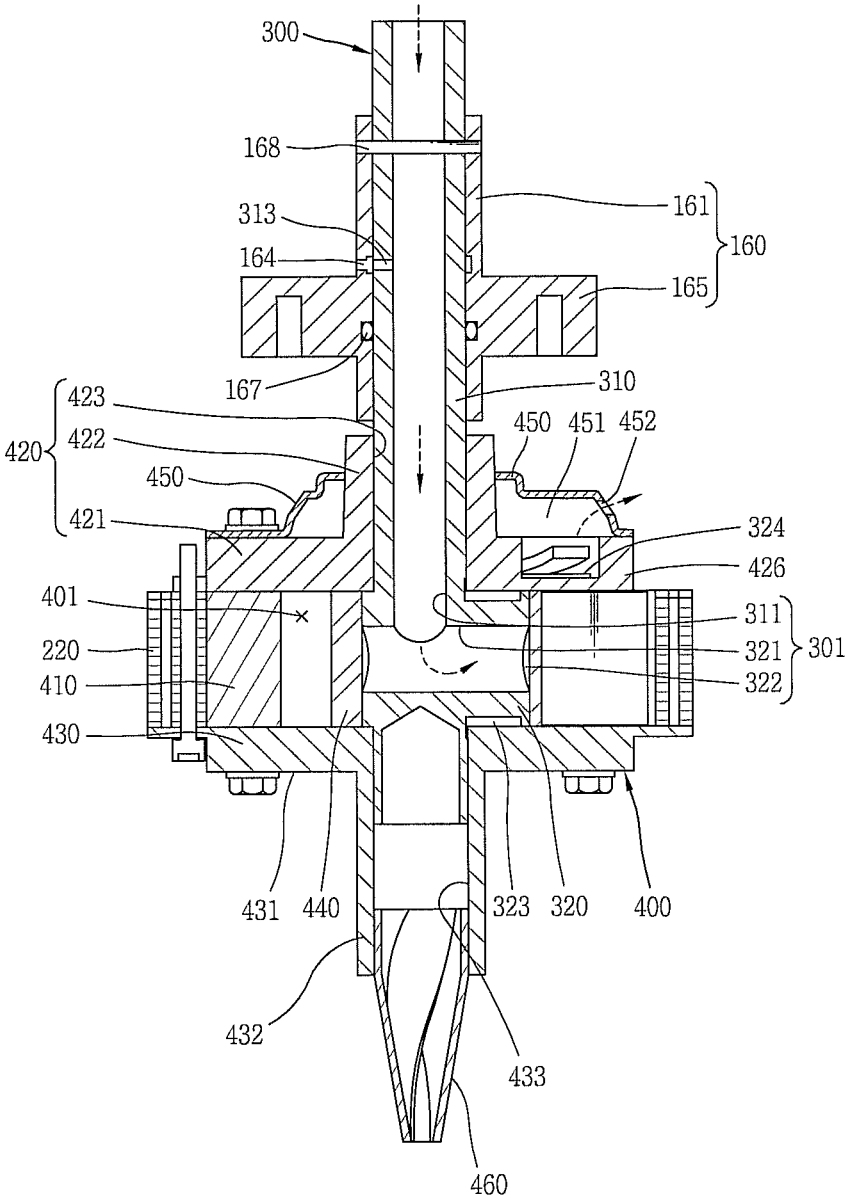
FIG. 2 is a cross-sectional view of a coupling between a stationary shaft and a compression device of the compressor of FIG. 1.
Figure 3:
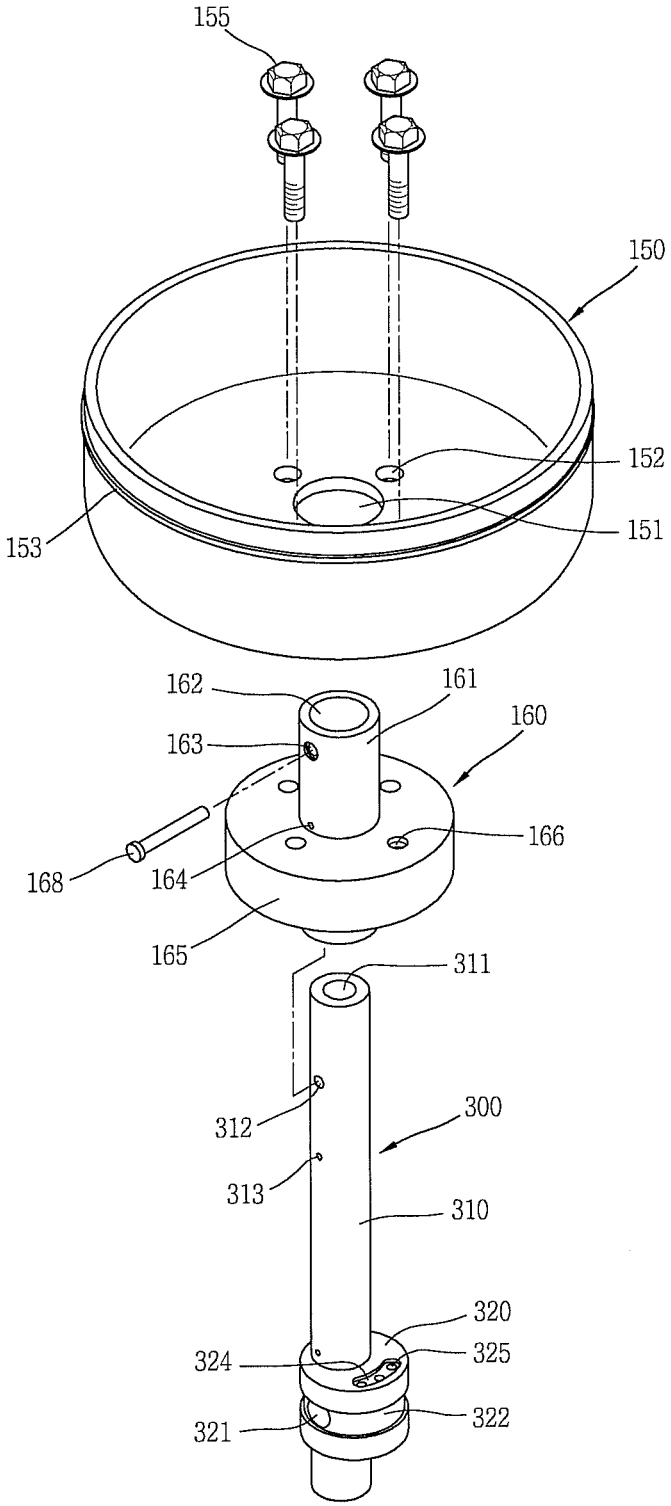
FIG. 3 is an exploded perspective view of an accumulator frame and the stationary shaft in the compressor of FIG. 1.

As illustrated in FIGS. 1 through 3, a compressor, which may referred to as a hermetic compressor, according to an embodiment may include a drive motor 200 that generates a rotational force installed in an internal space 101 of a sealed shell 100, which may be hermetically sealed, and a stationary shaft 300 fixed in the internal space 101 of the shell 100 at a center of the drive motor 200. The stationary shaft 300 may be rotatably coupled with a cylinder 410 coupled with a rotor 220 of the drive motor 200 to be rotated by the stationary shaft 300. An accumulator 500 having a predetermined accumulating chamber 501 may be provided separated within and from the internal space 101 of the shell 100 and coupled with the stationary shaft 300.

The shell 100 may include a shell body 110, within which the drive motor 200 may be installed, an upper cap 120 that forms an upper surface of the accumulator 500 while covering an upper open end (hereinafter, "first open end") 111 of the shell body 110, and a lower cap 130 that covers a lower open end (hereinafter, "second open end") 112 of the shell body 110. The shell body 110 may be formed in a cylindrical shape. A stator 210, which will be described later, may be fixed to a middle portion of the shell body 110 in, for example, a shrink-fitting manner. Further, a lower frame 140 that supports a lower bearing 430, which will be described later, in a radial direction, as well as the stator 210 may be fixed to the shell body 110 at a lower portion of the stator 210 by, for example, shrink-fitting. The lower frame 140 may include a bearing hole 141, into a center of which the lower bearing 430 may be rotatably inserted to support the stationary shaft 300, which will be described later, in a radial direction. An edge of the lower frame 140 may be bent and formed with a fixing portion 142 that allows an outer circumferential surface thereof to be closely adhered to the shell body 110. An outer front end surface of the lower frame 140, namely, an end of the fixing portion 142, may be closed adhered to a lower surface of the stator 210 and fixed to the shell body 110 to support the stator 210 in an axial direction.

Figure 4:
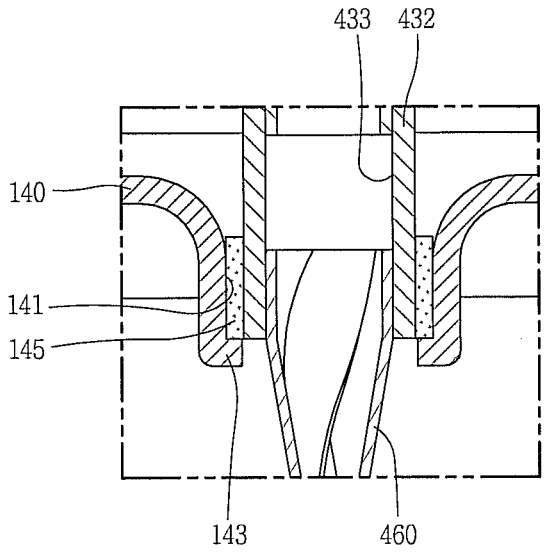
FIG. 4 is a cross-sectional view illustrating an embodiment in which a bearing member is provided between a lower frame and a lower bearing in the compressor of FIG. 1.

The lower frame 140 may be made of, for example, a metal plate or a casting. When the lower frame 140 is made of a metal plate, a separate bearing member 145, such as a ball bearing or bush, may be installed thereon, to provide lubrication between the lower frame 140 and the lower bearing 430, as illustrated in FIG. 4. However, when the lower frame 140 is made of a casting, a bearing hole 141 of the lower frame 140 may be precision processed, and therefore, a separate bearing member may not be required. When the separate bearing member 145 is installed between the lower frame 140 and the lower bearing 430, a bearing support portion 143 may be bent and formed to support the bearing member 145 at an end of the bearing hole 141 of the lower frame 140, as illustrated in FIG. 4.

Figure 5:
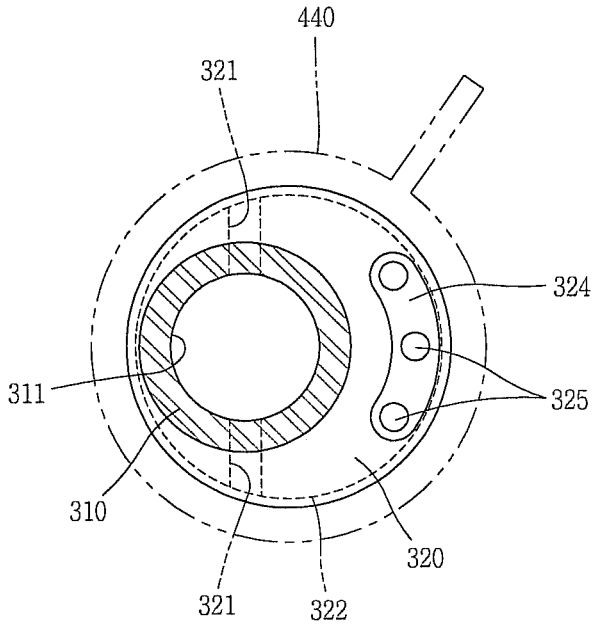
FIG. 5 is a plan view of an eccentric portion of the stationary shaft in the compressor of FIG. 1.

An accumulator frame 150, which may form a lower surface of the accumulator 500, may be provided at an upper end of the shell body 110. The accumulator frame 150 may include a bush hole 151, through a center of which a stationary bush (upper bush) 160, which will be described later, may penetrate and be coupled therewith. Further, one or more through hole(s) 152 configured to fasten the accumulator frame 150 and the stationary bush 160 by, for example, a bolt 155 may be formed at a periphery of the bush hole 151, as illustrated in FIG. 5. A diameter of the one or more through hole(s) 152 may be larger than a diameter of the bolt 155 or a diameter of one or more fastening hole(s) 166 provided in the stationary bush 160, by a clearance (t2), which may be advantageous during a process of centering the stationary shaft 300.

An edge of the accumulator frame 150 may be formed with a fixing portion 153 that extends in a radial direction a length to overlap with the shell body 110 and an end of the upper cap 120. The fixing portion 153 of the accumulator frame 150 may be closely adhered to an inner circumferential surface of the shell body 110 and an inner circumferential surface of the upper cap 120. The fixing portion 153 may be, for example, coupled to the shell body 110 and the end of the upper cap 120, so that the shell body 110, the upper cap 120, and the accumulator frame 150 are joined together, thereby enhancing a sealability of the shell 100. The fixing protrusion 153 may be interposed between the shell body 110 and the end of the upper cap 120, as shown in FIG. 1.

The stationary bush 160 may include the shaft receiving portion 161, which may be inserted into the bush hole 151 of the accumulator frame 150, and a flange portion 165 that extends in a radial direction at a middle portion of a circumferential surface of the shaft receiving portion 161. The shaft receiving portion 161 may include a shaft receiving hole 162, through a center of which the stationary shaft 300 may penetrate. A sealing member 167 that provides a seal between the accumulating chamber 501 of the accumulator 500 and the internal space 101 of the shell 100 may be provided at the middle portion of the shaft receiving portion 161.

The stationary bush 160 and the stationary shaft 300 may be fixed by using, for example, a fixing bolt or a fixing ring, other than the foregoing fixing pin 168. An oil drain hole 164 that collects oil separated from the accumulator 500 into compression space 401 through a refrigerant suction passage 301 of the stationary shaft 300 may be formed at the middle portion of the shaft receiving portion 161, namely, at a portion adjacent to the flange portion 165.

The flange portion 165 may be formed such that a radial directional width thereof is larger than a radial directional width of the shaft receiving portion 161, thereby allowing a clearance when the stationary bush 160 performs a centering operation together with the stationary shaft 300. One or more of the fastening hole(s) 166 may be formed at or in the flange portion 165 to correspond to the one or more through hole(s) 152 of the accumulator frame 150. A diameter of the fastening hole(s) 166 may be smaller than a diameter of the through hole(s) 152.

An edge of the upper cap 120 may be bent to face the first open end 111 of the shell body 110, and may be, for example, welded thereto together with the fixing portion 153 of the accumulator frame 150. Further, a suction pipe 102 that guides refrigerant to the accumulator 500 during a cooling cycle may penetrate and be coupled with the upper cap 120. The suction pipe 102 may be eccentrically disposed to one side of the upper cap 120, so as not to concentrically correspond to the refrigerant suction passage 301 of the stationary shaft 300, which will be described later, thereby preventing liquid refrigerant from being inhaled into the compression space 401. Furthermore, a discharge pipe 103 that guides refrigerant discharged into the internal space 101 of the shell 100 from the compression device 400 may penetrate and be coupled with the shell body 110 between the stator 210 and the accumulator frame 150. An edge of the lower cap 130 may be attached, for example, by welding to the second open end 112 of the shell body 110.

As illustrated in FIG. 1, the drive motor 200 may include a stator 210 fixed to the shell 100 and a rotor 220 rotatably disposed at an inner portion of the stator 210. The stator 210 may include a plurality of ring-shaped stator sheets laminated together to a predetermined height, and a coil 230 wound around a teeth portion provided at an inner circumferential surface thereof. Further, the stator 210 may be, for example, shrink-fitted to be fixed and coupled with the shell body 110 in an integrated manner. A front end surface of the lower frame 140 may be closely adhered and fixed to a lower surface of the stator 210.

An oil collecting hole 211 may be formed adjacent to and penetrate an edge of the stator 210 to pass oil collected in the internal space 101 of the shell 100 through the stator 210 into the lower cap 130. The oil collecting hole 211 of the stator 210 may communicate with an oil collecting hole 146 of the lower frame 140.

The rotor 220, which may include a magnet 212, may be disposed at an inner circumferential surface of the stator 210 with a predetermined gap therebetween and may be coupled with the cylinder 410, which will be described later, at a center thereof. The rotor 220 and cylinder 410 may be coupled with an upper bearing plate (hereinafter, "upper bearing") 420 and/or lower bearing plate (hereinafter, "lower bearing") 430, which will be described later, by, for example, a bolt. The rotor 220 and cylinder 410 may be molded in an integrated manner using, for example, a sintering process.

As illustrated in FIGS. 1 through 3, the stationary shaft 300 may include a shaft portion 310 having a predetermined length in an axial direction, both ends of which may be fixed to the shell 100, and an eccentric portion 320 that extends eccentrically at a middle portion of the shaft portion 310 in a radial direction and which is accommodated in the compression space 401 of the cylinder 410 to vary a volume of the compression space 401. The shaft portion 310 may be formed such that a center of the stationary shaft 300 corresponds to a rotational center of the cylinder 410 or a rotational center of the rotor 220 or a radial center of the stator 210 or a radial center of the shell 100, whereas the eccentric portion 320 may be formed such that the center of the stationary shaft 300 is eccentrically located with respect to the rotational center of the cylinder 410 or the rotational center of the rotor 220 or the radial center of the stator 210 or the radial center of the shell 100.

An upper end of the shaft portion 310 may be inserted into the accumulating chamber 501 of the accumulator 500, whereas a lower end of the shaft portion 310 may penetrate in an axial direction and be rotatably coupled with the upper bearing 420 and the lower bearing 430 to support the same in a radial direction.

A first suction guide hole 311, an upper end of which may communicate with the accumulating chamber 501 of the accumulator 500 to form the refrigerant suction passage 301, may be formed at an inner portion of the shaft portion 310 and having a predetermined depth in an axial direction, so as to extend nearly to a lower end of the eccentric portion 320, and a second suction guide hole 321, an end of which may communicate with the first suction guide hole 311 and the other end of which may communicate with the compression space 401, to form the refrigerant suction passage 301 together with the first suction guide hole 311, may penetrate the eccentric portion 320 in a radial direction.

The eccentric portion 320 may be formed in a disc shape having a predetermined thickness, as illustrated in FIG. 5, and thus, may be eccentrically formed with respect to a center of the shaft portion 310 in a radial direction. An eccentric amount of the eccentric portion 320 may be sufficiently large according to a capacity of the compressor, as the shaft portion 310 is fixed to and coupled with the shell 100.

Figure 7:
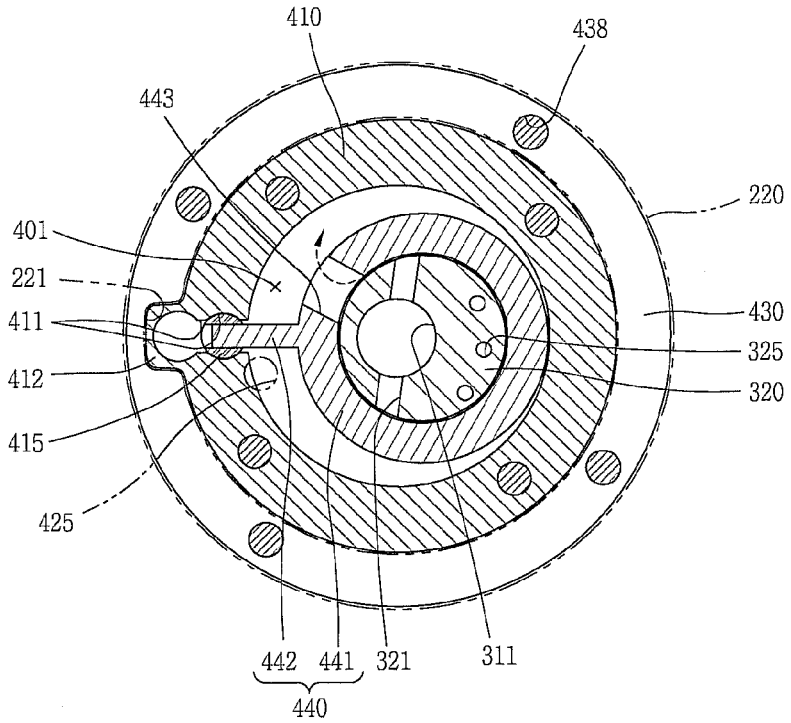
FIG. 7 is a cross-sectional view taken along line I-I of FIG. 6.

The second suction guide hole 321, which may form the refrigerant suction passage 301 together with the first suction guide hole 311, may penetrate an inner portion of the eccentric portion 320 in a radial direction. A plurality of second suction guide holes 321 may be formed in a straight line, as shown in FIG. 7; however, according to other circumstances, for example, the second suction guide hole 321 may penetrate and be formed in only one direction with respect to the first suction guide hole 311.

A suction guide groove 322 may be formed, for example, in a ring shape, at an outer circumferential surface of the eccentric portion 320 to communicate refrigerant at all times with a suction port 443 of the roller vane 440, which will be described later, through the second suction guide hole 321. Alternatively, the suction guide groove 322 may also be formed at an inner circumferential surface of the roller vane 440, or may be formed at both an inner circumferential surface of the roller vane 440 and an outer circumferential surface of the eccentric portion 320. Further, the suction guide groove 322 may not necessarily be in a ring shape, but rather, may also be formed in a long circular arc shape in a circumferential direction, for example. Other shapes of the suction guide groove 322 may also be appropriate.

Figure 6:
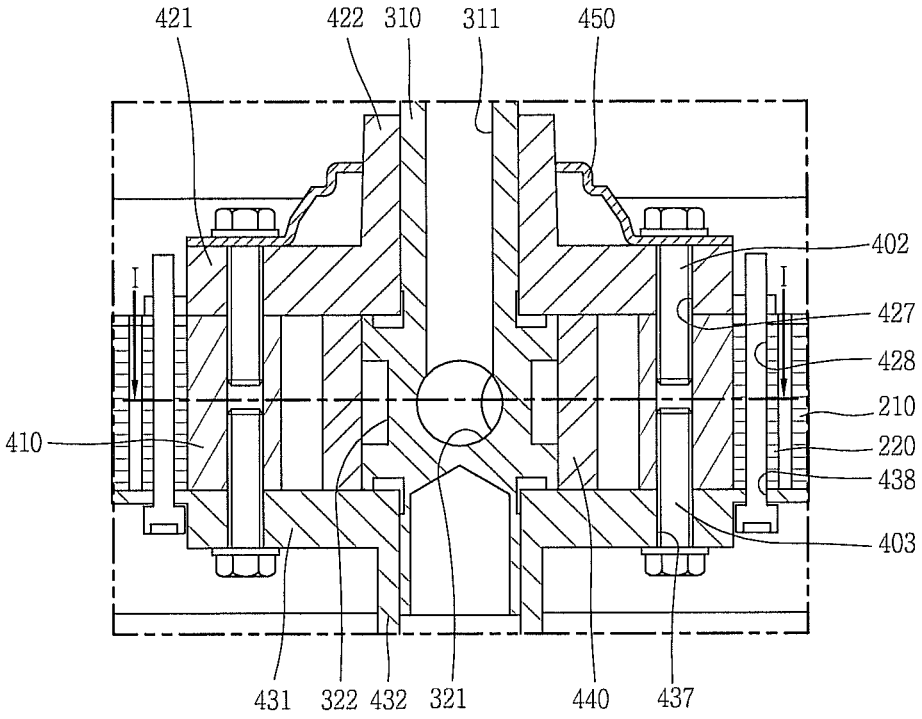
FIG. 6 is a cross-sectional view of the compression device in the compressor of FIG. 1.

The compression device 400 may be coupled with the eccentric portion 320 of the stationary shaft 300 to compress refrigerant while being rotated together with the rotor 220. As illustrated in FIGS. 6 and 7, the compression device 400 may include the cylinder 410, the upper bearing 420 and the lower bearing 430 positioned at both sides of the cylinder 410, respectively, to form the compression space 401, and the roller vein vane 440 provided between the cylinder 410 and the eccentric portion 320 to compress refrigerant while varying the compression space 401.

The cylinder 410 may be formed in a ring shape to form the compression space 401 therewithin. A rotational center of the cylinder 410 may be provided to correspond to an axial center of the stationary shaft 300. Further, a vane slot 411, into which the roller vane 440 may be slidably inserted in a radial direction while being rotated, may be formed at a side of the cylinder 410. The vane slot 411 may be formed in various shapes according to the shape of the roller vane 440. For example, a rotation bush 415 may be provided in the vane slot 411, such that a vane portion 442 of the roller vane 440 may be rotationally moved in the vane slot 411, when a roller portion 441 and the vane portion 442 of the roller vane 440 are formed in an integrated manner, as illustrated in FIG. 7. Further, the vane slot 411 may be formed in a slide groove shape, such that the vane portion 442 may be slidably moved in the vane slot 411 when the roller portion 441 and vane portion 442 are rotatably coupled with each other.

An outer circumferential surface of the cylinder 410 may be inserted into the rotor 220 and coupled therewith in an integrated manner. For example, the cylinder 410 may be pressed to the rotor 220 or fastened to the upper bearing 420 or the lower bearing 430 using, for example, fastening bolts 402, 403.

When the cylinder 410 and upper bearing 420 are fastened by or to the lower bearing 430, an outer diameter of the lower bearing 430 may be formed larger than that of the cylinder 410, whereas an outer diameter of the upper bearing 420 may be formed to be approximately similar to that of the cylinder 410. Further, a first through hole 437 configured to fasten the cylinder 410 and a second through hole 438 configured to fasten the rotor 220 may be formed, respectively, on the lower bearing 430. The first through hole 437 and second through hole 438 may be formed on radially different lines to enhance a fastening force, but may also be formed on the same line based on assembly considerations. A fastening bolt 402 may pass through the lower bearing 430 and be fastened to the cylinder 410 and a fastening bolt 403 may pass through the upper bearing 420 (via first through hole 427) and be fastened to the cylinder 410. The fastening bolts 402 and 403 may be formed to have the same fastening depth.

Figure 8:
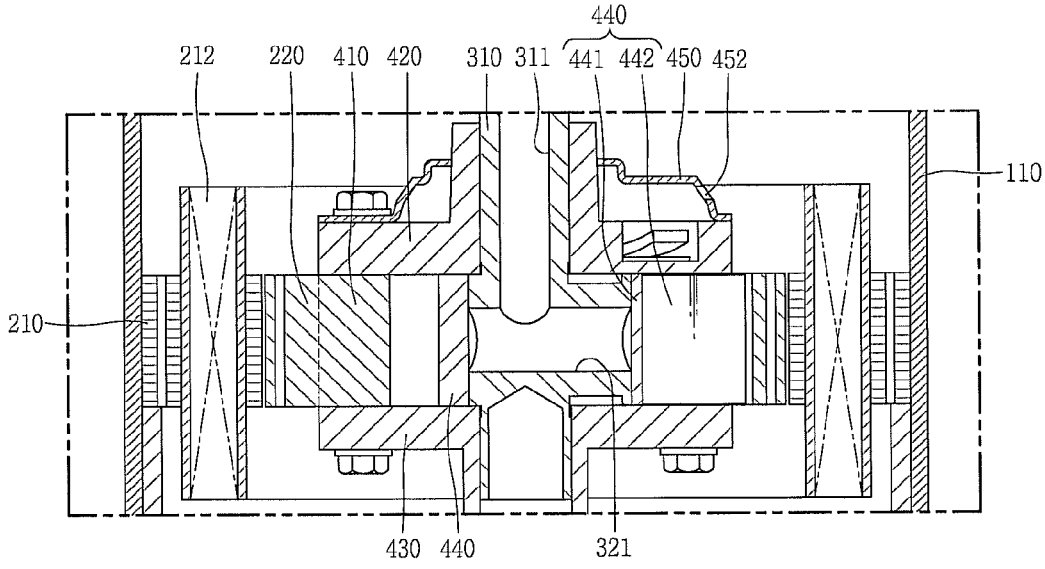
FIG. 8 is a cross-sectional view of a coupling between a cylinder and a rotor in the compressor of FIG. 1, according to another embodiment.

The cylinder 410 may be molded together with the rotor 220 in an integrated manner, as illustrated in FIG. 8. For example, the cylinder 410 and rotor 220 may be molded in an integrated manner through, for example, a powder metallurgy or die casting process. In this case, the cylinder 410 and rotor 220 may be formed using the same material, or different materials. When the cylinder 410 and rotor 220 are formed using different materials, the cylinder 410 may be formed of a material having a relatively high abrasion resistance in comparison to the rotor 220. Further, when the cylinder 410 and rotor 220 are formed in an integrated manner, the upper bearing 420 and the lower bearing 430 may be formed to have the same or a smaller outer diameter than that of the cylinder 410, as illustrated in FIG. 8.

Figure 9:
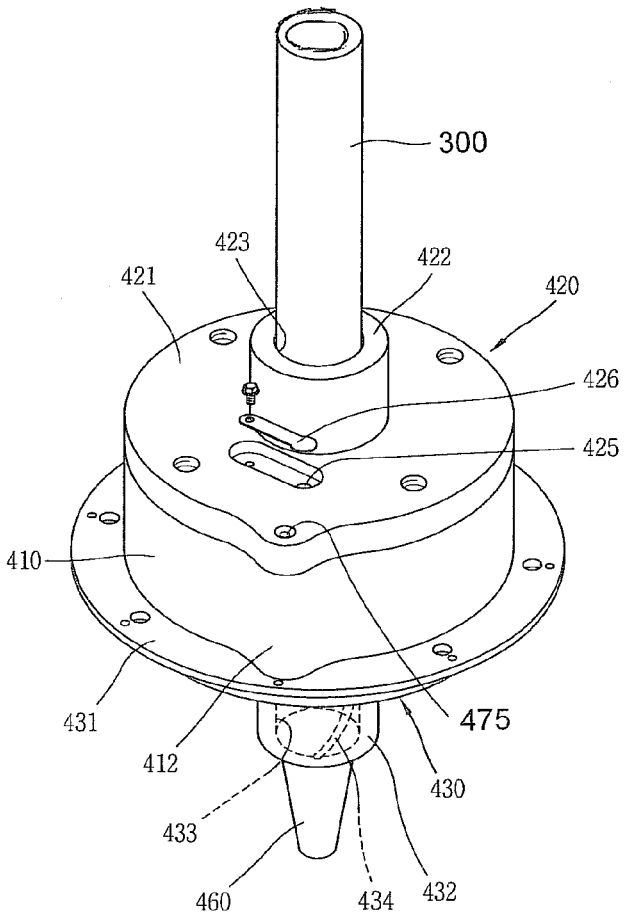
FIG. 9 is a perspective view of the compression device in the compressor of FIG. 1.

As illustrated in FIG. 7, a protrusion portion 412 and a groove portion 221 may be formed at an outer circumferential surface of the cylinder 410 and an inner circumferential surface of the rotor 220, respectively, to enhance a combining force between the cylinder 410 and the rotor 220, as illustrated in FIG. 9. The vane slot 411 may be formed within a range of a circumferential angle formed by the protrusion portion 412 of the cylinder 410. A plurality of protrusion portions and groove portions may be provided. When a plurality of protrusion portions and groove portions are provided, they may be formed at a same interval along the circumferential direction to cancel out magnetic unbalance.

As illustrated in FIG. 9, the upper bearing 420 may be formed such that a shaft receiving portion 422 that supports the shaft portion 310 of the stationary shaft 300 in a radial direction protrudes upward a predetermined height at a center of an upper surface of the stationary plate portion 421. The rotor 220, the cylinder 410, and a rotating body including the upper bearing 420 and the lower bearing 430, which will be described later, may have a rotational center corresponding to an axial center of the stationary shaft 300. Thus, the rotating body may be efficiently supported even though the shaft receiving portion 422 of the upper bearing 420 or the shaft receiving portion 432 of the lower bearing 430 do not have as long a length.

The stationary plate portion 421 may be formed in a disc shape and may be fixed to an upper surface of the cylinder 410. A shaft receiving hole 423 of the shaft receiving portion 422 may be formed to be rotatably coupled with the stationary shaft 300. An oil groove 424, which will be described later, may be formed in, for example, a spiral shape at an inner circumferential surface of the shaft receiving hole 423.

A discharge port 425 may be formed at a side of the shaft receiving portion 422 that communicates with the compression space 401, and a discharge valve 426 may be formed at an outlet end of the discharge port 425. Further, a muffler 450 that reduces discharge noise of refrigerant being discharged through the discharge port 425 may be coupled with an upper side of the upper bearing 420.

As illustrated in FIGS. 6 and 9, the lower bearing 430 may be formed to be symmetrical to the upper bearing 420, such that a shaft receiving portion 432, which supports the shaft portion 310 of the stationary shaft 300 in a radial direction, protrudes downward a predetermined height at a center of a lower surface of the stationary plate portion 421. Further, the rotor 220, the cylinder 410, and the rotating body including the upper bearing 420 and the lower bearing 430 may have a rotational center corresponding to an axial center of the stationary shaft 300, and thus, the rotating body may be efficiently supported even though the shaft receiving portion 432 of the lower bearing 430 does not have as long a length as in the shaft receiving portion 422 of the upper bearing 420.

The stationary plate portion 431 may be formed in, for example, a disc shape and may be fixed to a lower surface of the cylinder 410. A shaft receiving hole 433 of the shaft receiving portion 432 may be formed to be rotatably coupled with the stationary shaft 300. An oil groove 434, which will be described later, may be formed, for example, in a spiral shape at an inner circumferential surface of the shaft receiving hole 433.

When the cylinder 410 and rotor 220 are formed in a separated manner, the rotor 220 and the cylinder 410 may be coupled with each other by means of the stationary plate portion 431 of the lower bearing 430. Alternatively, the cylinder 410 and rotor 220 may be coupled in an integrated manner by means of the upper bearing 420.

Figure 10:
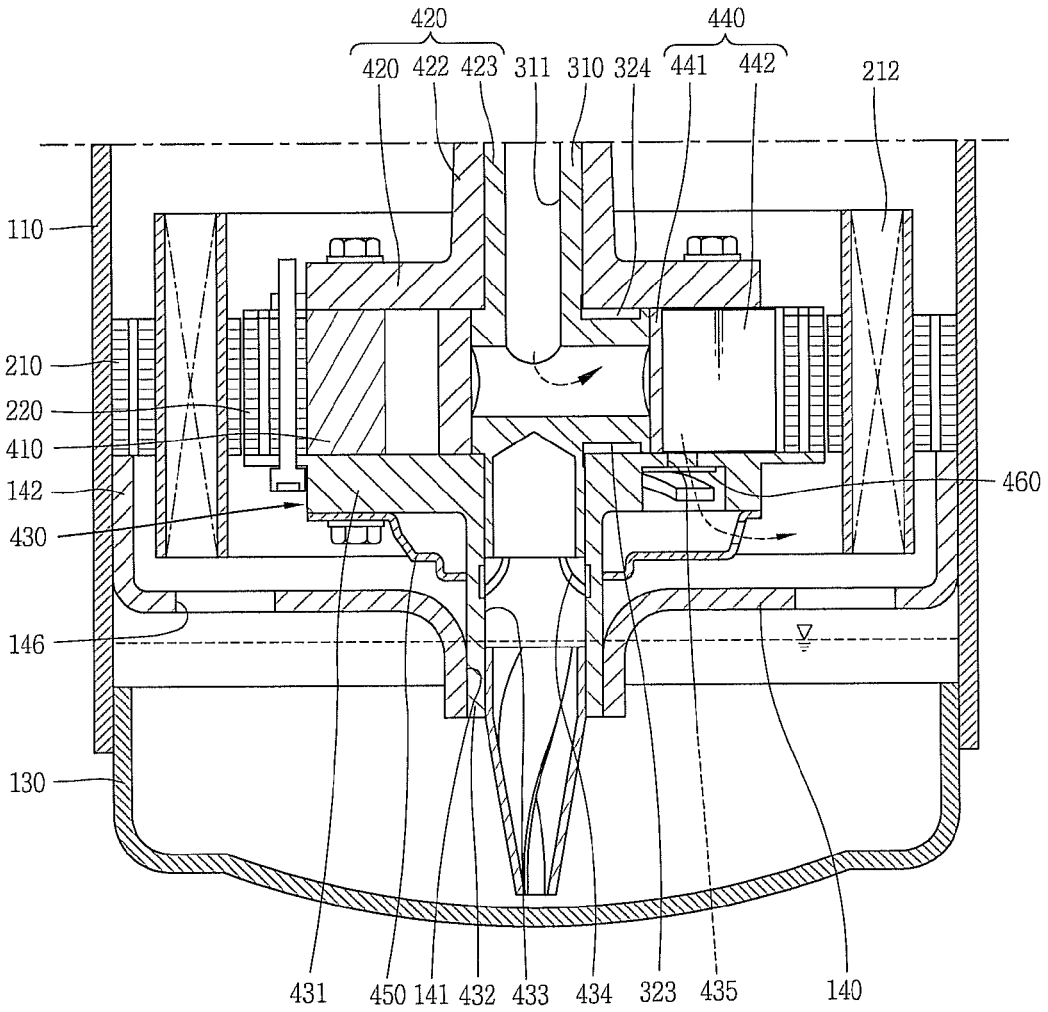
FIG. 10 is a cross-sectional view illustrating a state in which refrigerant is discharged through a muffler in the compressor of FIG. 1.

Further, the discharge port may not be formed on the upper bearing 420, but rather, may be formed on the lower bearing 430, as illustrated in FIG. 10. In this case, the muffler 450 may be coupled with the lower bearing 430, and an exhaust through hole 452 of the muffler 450 may penetrate and be formed in an axial or radial direction in the noise space 451. More particularly, when the discharge port 435 is formed on the lower bearing 430, refrigerant may interfere with oil stored when the exhaust through hole 452 of the muffler 450 penetrates in an axial direction, and thus, the exhaust through hole 452 may penetrate in a radial direction toward the coil to reduce interference between refrigerant and oil or enhance a cooling effect of the coil.

Figure 11:
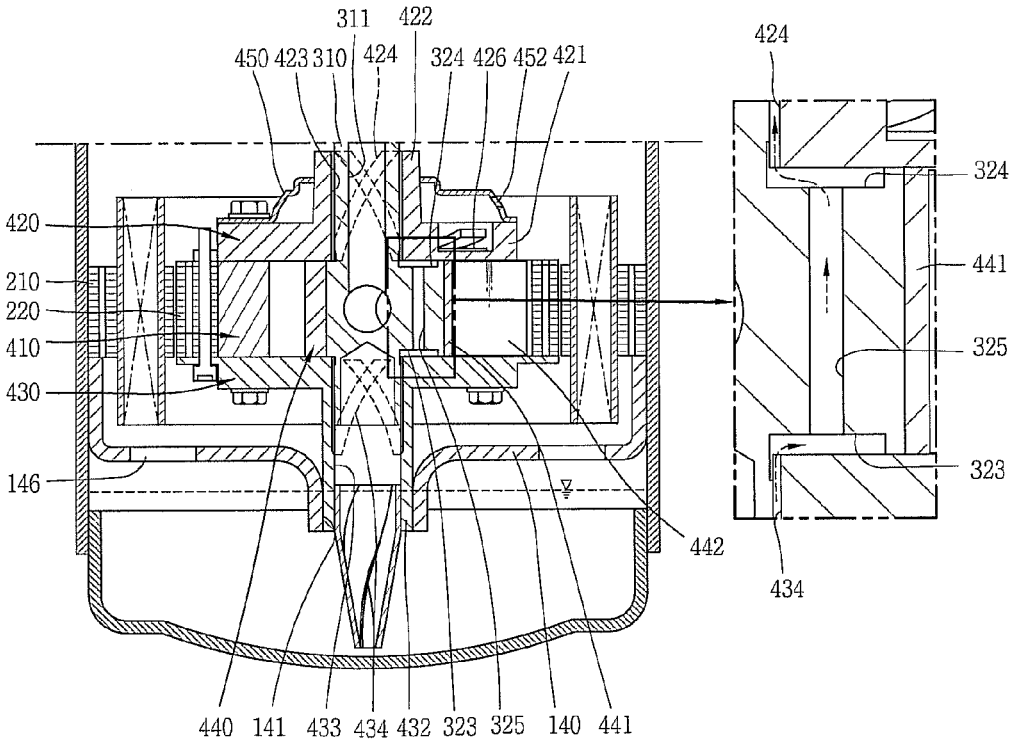
FIG. 11 is a cross-sectional view of an oil supply structure of a compression device in the compressor of FIG. 1.

Meanwhile, as illustrated in FIGS. 1, 9 and 11, an oil feeder 460 that pumps oil collected in the lower cap 130 may be coupled with a lower end of the shaft receiving hole 433 of the lower bearing 430, and an outlet port of the oil feeder 460 may communicate with the oil groove 434 of the lower bearing 430.

Further, a bottom oil pocket 323 may be formed at a bottom surface of the eccentric portion 320 that communicate with the oil groove 434 of the lower bearing 430, and one or more oil through hole(s) 325 that guides oil collected in the bottom oil pocket 323 to the oil groove 424 of the upper bearing 420 may penetrate in an axial direction an inner portion of the bottom oil pocket 323. A top oil pocket 324 may be formed at a top surface of the eccentric portion 320 that communicates with the oil through hole(s) 325, and the top oil pocket 324 may communicate with the oil groove 424 of the upper bearing 420.

A cross-sectional area of the bottom oil pockets 323, 324 may be broader than a total cross-sectional area of the oil through hole(s) 325, and the oil through hole(s) 325 may not overlap with the second suction guide hole 321, thereby efficiently moving refrigerant and oil.

Figure 12:
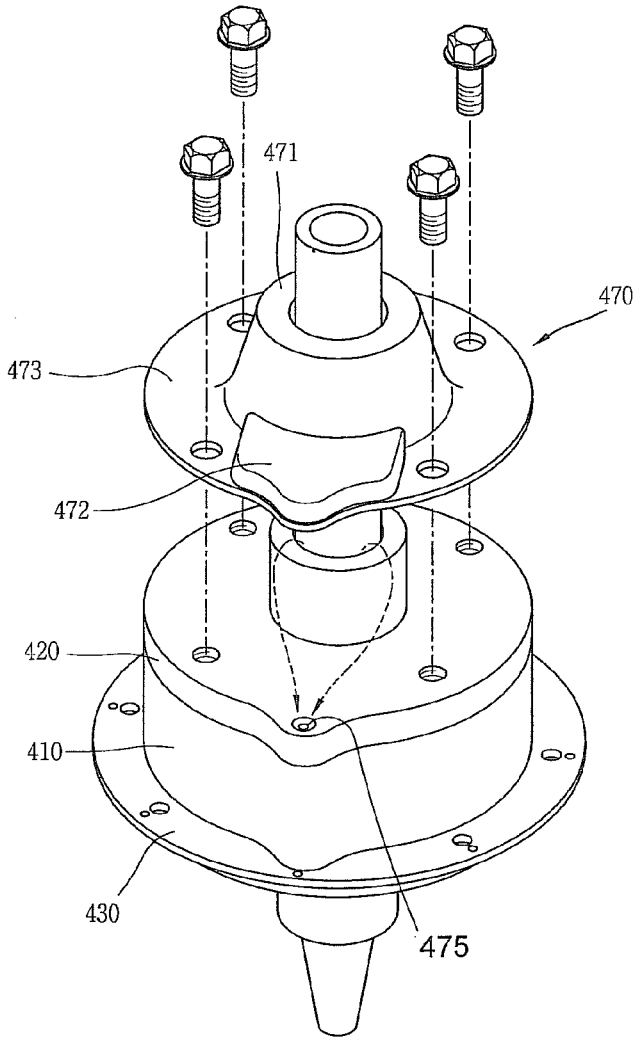
FIG. 12 is an exploded perspective view of an oil collecting plate provided at an upper side of the upper bearing in the compressor of FIG. 1.

When the muffler 450 is installed at the lower bearing 430 to discharge compressed refrigerant to the bottom side, an oil collecting plate 470 that collects oil that has been sucked up to the shaft receiving hole 423 of the upper bearing 420 and that provides lubrication between the vane slot 411 and the vane portion 442 may be installed at an upper side of the upper bearing 420, as illustrated in FIG. 12. In this case, an oil guide hole 475 may be formed on the upper bearing 420 to allow oil being collected by the oil collecting plate 470 to be guided between the vane slot 411 and the vane portion 442.

Figure 13:
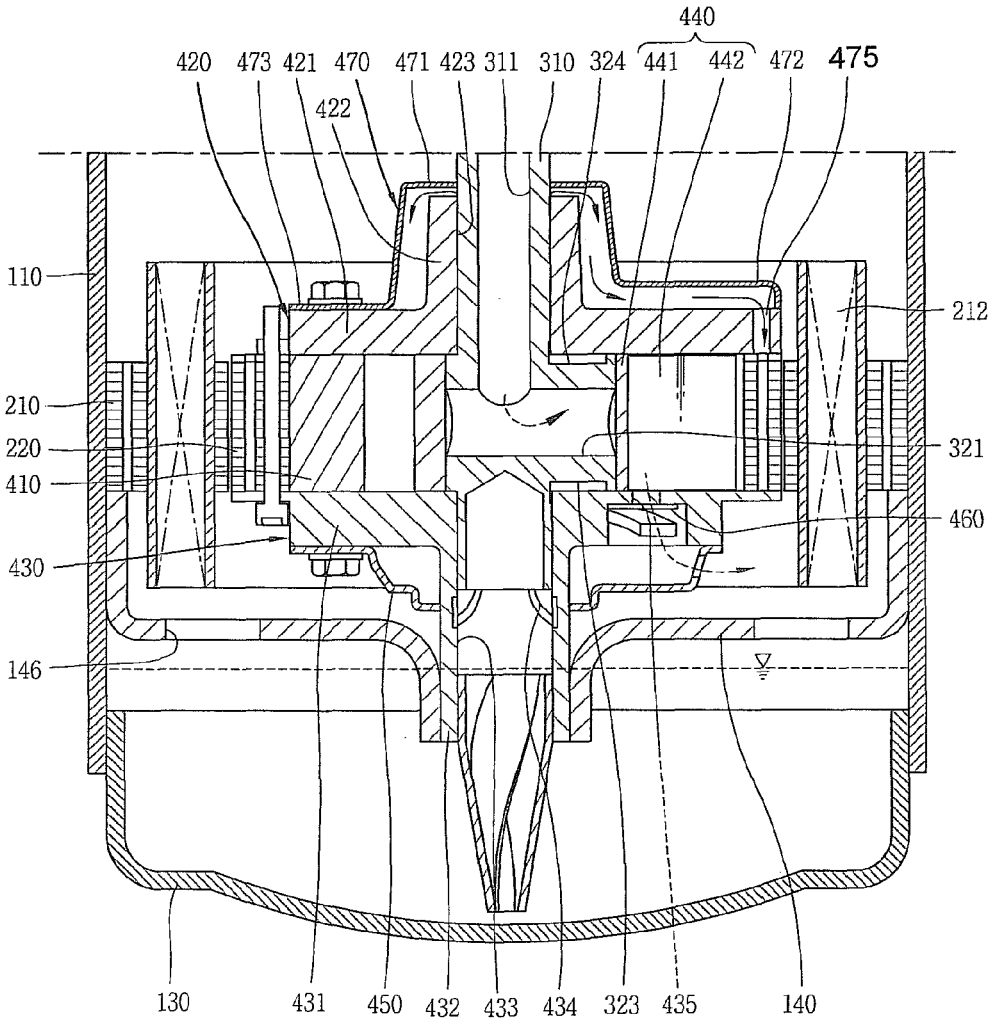
FIG. 13 is a cross-sectional view of an oil recovery process using an oil collecting plate in the compressor of FIG. 12.

For the oil collecting plate 470, an oil collecting portion 471 may protrude such that a central portion thereof surrounds an upper end of the shaft receiving portion 422 of the upper bearing 420, as illustrated in FIG. 13, and an oil guide portion 472 that extends from a lower end side of the oil collecting portion 471 toward the oil guide hole 475 communicates with the vane slot 411 of the cylinder 410 to guide oil that has been collected in the oil collecting portion 471 to the vane slot 411 (more particularly, a rear end of the vane slot), or oil guide hole 475 may be formed thereon. The oil guide portion 472 may extend from a lower end of the oil collecting portion 471 and a portion of stationary portion 473 fixed to an upper surface of the upper bearing 420 may protrude to form an oil passage. Further, the oil guide portion 472 may be formed to accommodate the vane slot 411 or an oil guide hole 475 at an inner portion thereof.

Though not shown in the drawing, when a discharge port is formed on the upper bearing, a noise space 452 of the muffler may be formed at a height capable of accommodating the shaft receiving portion of the upper bearing, or an oil collecting portion may be formed in the noise space to collect oil being exhausted through the discharge port of the upper bearing.

The accumulator 500 may be formed separated within and from the internal space 101 of the shell 100, as the accumulator frame 150 is sealed and coupled with an inner circumferential surface of the shell body 110, as described above. For the accumulator frame 150, an edge of a circular plate body may be bent and an outer circumferential surface thereof attached to, for example, welded and coupled with a joint portion between the shell body 110 and the upper cap 120, while being closely adhered to an inner circumferential surface of the shell body 110 and an inner circumferential surface of the upper cap 120, to seal the accumulating chamber 501 of the accumulator 500.

A compressor having the foregoing configuration according to embodiments may be operated as follows.

When the rotor 220 is rotated by applying power to the stator 210 of the drive motor 200, the cylinder 410 coupled with the rotor 220 through the upper bearing 420 or the lower bearing 430 may be rotated with respect to the stationary shaft 300. Then, the roller vane 440 slidably coupled with the cylinder 410 may generate a suction force as it divides the compression space 401 of the cylinder 410 into a suction chamber and a discharge chamber.

Then, refrigerant may be inhaled into the accumulating chamber 501 of the accumulator 500 through the suction pipe 102, and the refrigerant divided into gas refrigerant and liquid refrigerant in the accumulating chamber 501 of the accumulator 500. The gas refrigerant may be inhaled into the suction chamber of the compression space 401 through the first suction guide hole 311 and the second suction guide hole 321 of the stationary shaft 300, the suction guide groove 322, and the suction port 443 of the roller vane 440. The refrigerant inhaled into the suction chamber may be compressed while being moved to the discharge chamber by the roller vane 440 as the cylinder 410 continues to be rotated, and discharged to the internal space 101 of the shell 100 through the discharge port 425. The refrigerant discharged to the internal space 101 of the shell 100 may repeat a series of processes before being discharged to a cooling cycle apparatus through the discharge pipe 103. At this time, oil in the lower cap 130 may be pumped by oil feeder 460 provided at a lower end of the lower bearing 430, while the lower bearing 430 is rotated at high speed together with the rotor 220, and passed sequentially through the oil groove 434 of the lower bearing 430, the bottom oil pocket 323, the oil through hole(s) 325, the top oil pocket 324, and the oil groove 424 of the upper bearing 420, to be supplied to each sliding surface.

Hereinafter, an assembly sequence of a compressor according to embodiments will be described.

In a state that the stator 210 and the lower frame 140 of the drive motor 200 are fixed to the shell body 110 in, for example, a shrink-fitting manner, the stationary shaft 300 may be inserted into the stationary bush 160 to be fixed by means of, for example, the fixing pin 168. The rotor 220, the cylinder 410, and both the bearings 420, 430 may be coupled with the stationary shaft 300.

Next, in a state of maintaining a concentricity of the stator 210 and the rotor 220, the accumulator frame 150 may be inserted into the shell body 110 to fasten the stationary bush 160 to the accumulator frame 150, and the accumulator frame 150 may be, for example, three-point welded to the shell body 110 for a temporary fix.

Then, the lower cap 130 may be, for example, pressed to the second open end 112 of the shell body 110, and a joint portion between the lower cap 130 and the shell body 110 may be, for example, circumferentially welded to be sealed.

Next, the upper cap 120 may be, for example, pressed to the upper open end 111 of the shell body 110, and a joint portion between the upper cap 120 and the shell body 110 may be, for example, circumferentially welded together with the accumulator frame 150 to seal the internal space 101 of the shell 100, while forming the accumulating chamber 501 of the accumulator 500.

As described above, a portion of the internal space of the shell may be used from the accumulator, which may be installed separated within and from the internal space of the shell, thereby reducing a size of the compressor including the accumulator.

Further, an assembly process of the accumulator and the assembly process of the shell may be unified to simplify an assembly process of the compressor. Further, an accumulating chamber of the accumulator may be directly connected to a refrigerant suction passage of the stationary shaft by coupling the stationary shaft with the accumulator to prevent leakage of refrigerant from occurring, thereby enhancing compressor performance. Furthermore, an area required for installing the compressor may be minimized when installing the compressor including the accumulator in an outdoor device, thereby enhancing design flexibility of the outdoor device. A center of gravity of the accumulator may be placed at a location corresponding to that of the entire compressor including the accumulator, thereby reducing vibration noise of the compressor due to the accumulator. Also, an eccentric portion for forming a compression space in the stationary shaft may be provided, while an axial center of the stationary shaft may correspond to a rotational center of the cylinder, thereby securing a spacious compression space and increasing compressor capacity.

Furthermore, a length of an oil passage may be reduced by forming an oil passage on the lower bearing, the eccentric portion of the crank shaft, and the upper bearing, and due to this, oil may be efficiently supplied to a sliding portion even during a low speed operation with a reduced centrifugal force, thereby reducing a frictional loss of the compressor.

Further, the stator and lower frame may be, for example, shrink-fitted at the same time to be fixed to the shell, thereby preventing the shell from being thermally deformed in a non-uniform manner while the concentricity of the stator is distorted, as well as allowing the lower frame to support a bottom surface of the stator to more securely fix the stator. Both ends of the stationary shaft may be supported by a frame fixed to the shell in a radial direction, thereby effectively suppressing movement of the stationary shaft due to vibration generated during rotation of the rotational body, as well as enhancing durability and reliability of the compressor, although a separate bearing is not installed between the stationary shaft and rotational body or the bearing is used to the minimum.

The cylinder or bearing(s) may not be required to be welded, as the cylinder is combined with the bearings together with the rotor, thereby preventing deformation of the cylinder due to welding heat from occurring. Moreover, a fastening force imposed on the cylinder may be dispersed as a bearing is fastened to the cylinder and rotor, thereby preventing deformation of the cylinder from occurring. Also, when the cylinder and rotor are molded in an integrated manner, a width of the cylinder and rotor may be broadened to increase a resistance strength to fastening deformation, thereby preventing deformation of the cylinder from occurring.

Further, an oil collecting plate may be installed at an upper end of the upper bearing to guide oil collected in the oil collecting plate to the vane and the vane slot, and thus, oil remaining in the shell may be efficiently supplied to the vane and the vane slot, even without being submerged to a contacting surface between the vane and the vane slot. Through this, operation of the vane may be efficiently carried out, thereby preventing a compression loss due to the roller vane from occurring.

Interference with other components due to the compressor may be minimized to allow the compressor having a weight relatively higher than that of other components to be installed at a center of gravity of an outdoor device, thereby facilitating movement and installation of the outdoor device.

Another embodiment of an accumulator in a compressor will be described hereinbelow.

Figure 14:
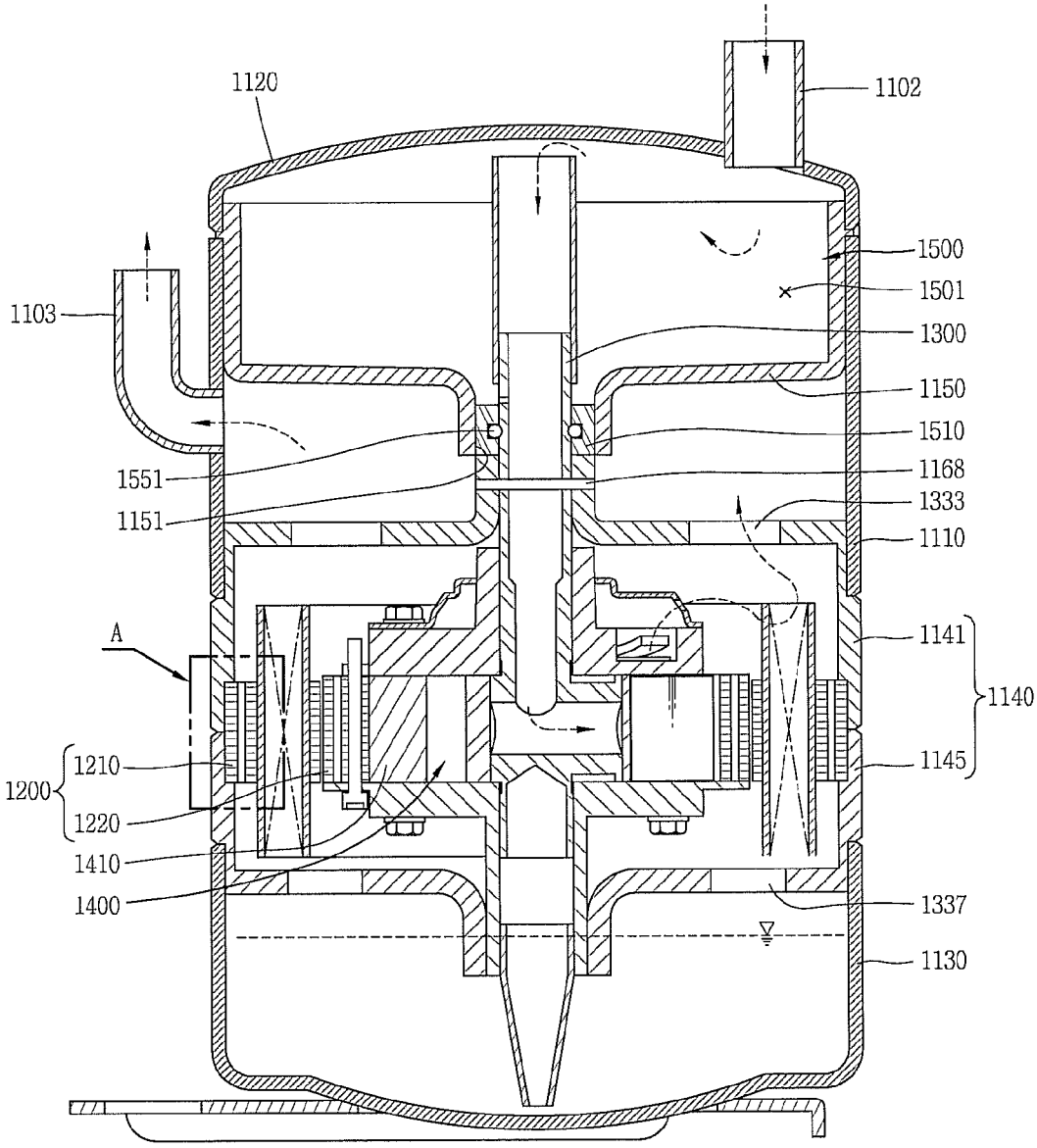
FIG. 14 is a cross-sectional view of a compressor according to another embodiment.

According to the foregoing embodiment, the stator 210 and the accumulator frame 150 may be fixed in, for example, a shrink-fitting manner at the same time to an inner circumferential surface of the shell 100; however, according to this embodiment, the stator 1210 may be inserted and fixed to the shell 1100, as illustrated in FIG. 14.

That is, the shell 1100 may include an upper shell 1110, a lower shell 1130, and a middle shell 1140 located between the upper shell 1110 and lower shell 1130. The drive motor 1200 and compression device 1400 may be installed together in the middle shell 1140, and the driving shaft 1300 may penetrate and be coupled with the middle shell 1140.

The upper shell 1110 may be formed in a cylindrical shape, and a lower end thereof may be coupled with an upper frame 1141 of the middle shell 1140, which will be described later, whereas an upper end thereof may be coupled with an upper cap 1120. Further, a suction pipe 1102 may be coupled with the upper shell 1110, and an accumulator frame 1150 may be coupled with an inner circumferential surface of the upper shell 1110 to form an accumulating chamber 1501 of the accumulator 1500 together with the upper cap 1120.

A bush hole 1151 may be formed at a center of the accumulator frame 1150. A sealing bush 1510 may be provided between an inner circumferential surface of the bush hole 1151 and an outer circumferential surface of the stationary shaft 1300. A sealing member 1551 may be inserted into an inner circumferential surface of the sealing bush 1510 to seal the accumulating chamber 1501 of the accumulator 1500.

The bush hole 1151 may protrude and extend downward in the form of a burr. Further, an upper end of the stationary shaft 1300 may be positioned adjacent to an upper surface of the accumulator frame 1150. A separate extension pipe 1310 may be connected to an upper end of the stationary shaft 1300. The separate extension pipe 1310 may have an inner diameter greater than that of the stationary shaft 1300 (i.e., an inner diameter of the refrigerant suction passage) to reduce suction loss.

The lower shell 1130 may be formed in, for example, a cup shape, such that an upper end thereof is open and a lower end thereof closed. The open upper end may be coupled with a lower frame 1145, which will be described later.

Figure 15:
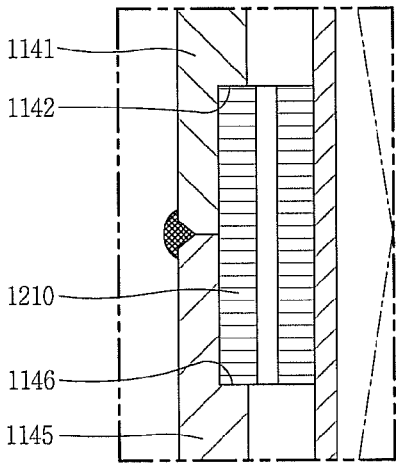
FIG. 15 is an enlarged cross-sectional view of a stator fixing structure in the compressor of FIG. 14, according to an embodiment.

The middle shell 1140 may be divided into an upper frame 1141 and a lower frame 1145 with respect to the stator 1210 of the drive motor 1200. Further, as illustrated in FIG. 15, grooves 1142, 1146 may be formed at a bottom end of the upper frame 1141 and a top end of the lower frame 1145, respectively, that face each other, which allow lateral surfaces of the stator 1210 to be inserted and supported thereby. Furthermore, a communication hole 1333 that guides refrigerant discharged from the compression device 1400 may be formed on the upper frame 1141, and an oil hole 1337 that collects oil may be formed on the lower frame 1145.

The other basic configuration and working effects thereof in the compressor according to this embodiment as described above may be substantially the same as the foregoing embodiment. However, according to this embodiment, the stator 1210 may be inserted and fixed between the upper frame 1141 and the lower frame 1145 forming part of the shell, and thus, easily assembled based on a concentricity between the stator 1210 and driving shaft 1300. In other words, according to this embodiment, the stator 1210 may be mounted on the groove 1146 of the lower frame 1145, then the driving shaft 1300 coupled with the rotor 1220 and the cylinder 1410 inserted into the stator 1210, and the upper frame 1141 inserted onto the stationary shaft 1300 to support an upper surface of the stator 1210 via the groove 1142 of the upper frame 1141. The upper frame 1141 and the lower frame 1145 may be attached, for example, welded, and coupled with each other, and the upper shell 1110 coupled with the accumulator frame 1150 may be inserted onto the upper frame 1141, which may be attached, for example, welded to the upper shell 1110. At this time, prior to attaching the upper frame 1141 to the lower frame 1145, a gap maintaining member, such as a gap gauge, may be inserted between the stator 1210 and the rotor 1220, and then the upper shell 1110 may be adjusted in a radial direction. As a result, the stationary shaft 1300 may maintain a concentricity with respect to the stator 1210. Accordingly, components may be easily assembled based on a concentricity of the stationary shaft when compared to the method of fastening and fixing the stationary bush to the accumulator frame while adjusting the stationary bush in a radial direction in a state in which the gap maintaining member is inserted between the stator and rotor, as described.

According to this embodiment, the stationary shaft 1300 may be supported in an axial direction with respect to the upper frame 1141 using a stationary member 1168, such as a fixing pin, a fixing bolt, or a fixing ring, that passes through the upper frame 1141 and stationary shaft 1300. However, the stationary shaft 1300 may be supported in an axial direction by supporting a lower end of the bush hole 1151 of the accumulator frame 1150 with the upper frame 1141. In this case, the sealing bush 1510 may be, for example, pressed and fixed to the bush hole 1151 of the accumulator frame 1150, and the stationary shaft 1300 may be, for example, pressed to the sealing bush 1510 or fixed by using another stationary member.

Still another embodiment of a compressor will be described hereinbelow.

According to the foregoing embodiment, the accumulator includes an accumulating chamber which may use a portion of the shell, namely, an upper cap, but according to this embodiment, the accumulator may be formed to have a separate accumulating chamber in the internal space of the shell and coupled with an inner circumferential surface of the shell to be separated by a predetermined distance.

Figure 16:
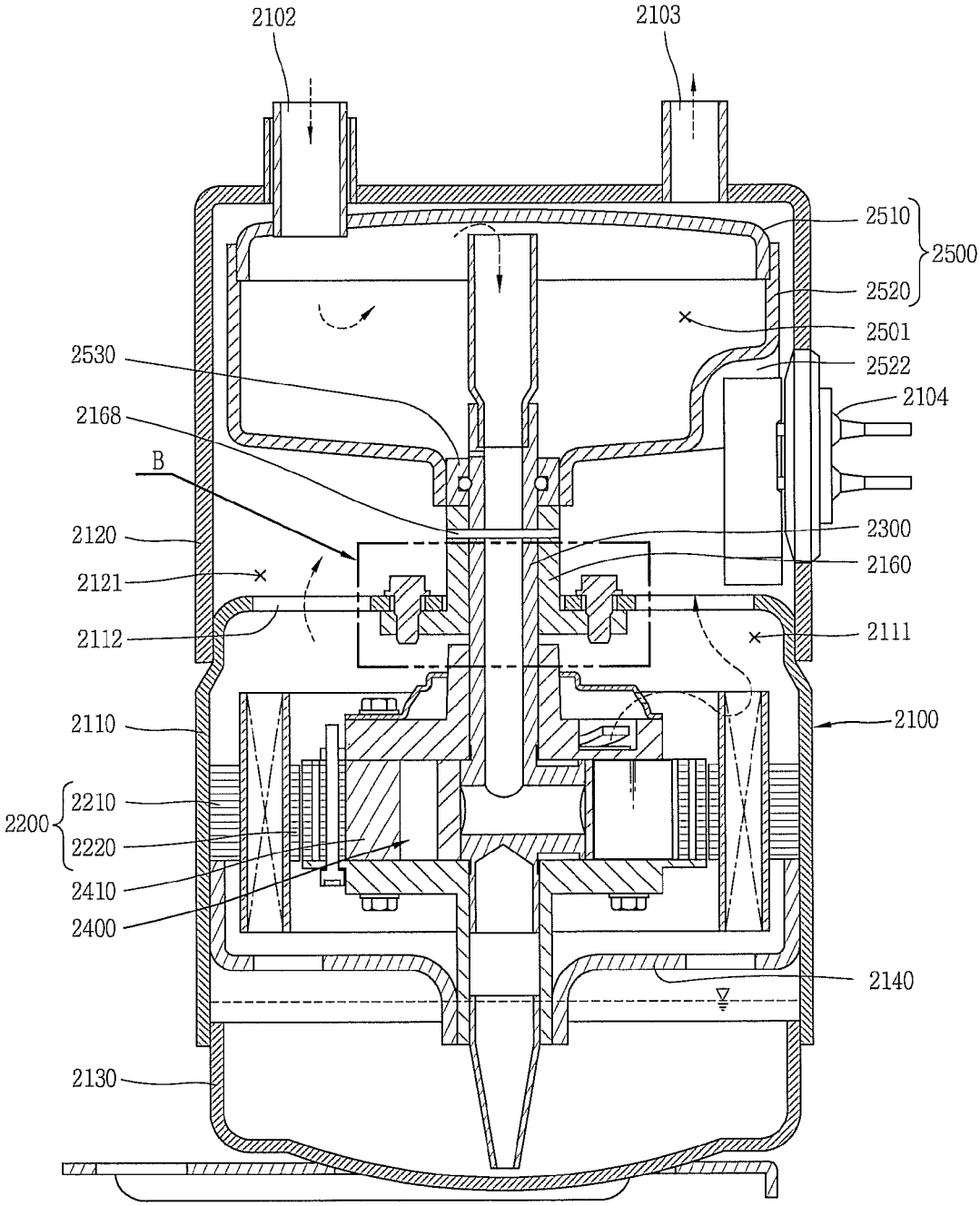
FIG. 16 is a cross-sectional view of a compressor according to still another embodiment.

As illustrated in FIG. 16, according to this embodiment, the drive motor 2200 and compression device 2400 may be installed in the shell body 2110, a lower end of which may be open to form part of the shell 2100. A lower end of the shell body 2110 may be sealed by lower cap 2130. A top shell 2120 may be coupled with an upper end of the shell body 2110, and a communication hole 2112 may be formed at an upper surface of the shell body 2110, such that an internal space 2111 of the shell body 2110 may communicate with an internal space 2121 of the top shell 2120. Further, the stationary shaft 2300 may be inserted into a center of the shell body 2110 to fasten the stationary bush 2160 by means of, for example, a fixing pin 2168. The accumulator 2500 separated by a predetermined distance to have a separate accumulating chamber 2501 in the internal space of the top shell 2120 may be coupled with an upper end of the stationary shaft 2300. The accumulator 2500 may be fixed to the shell by means of a suction pipe 2102 that passes through the top shell 2120 and coupled therewith.

Figure 17:
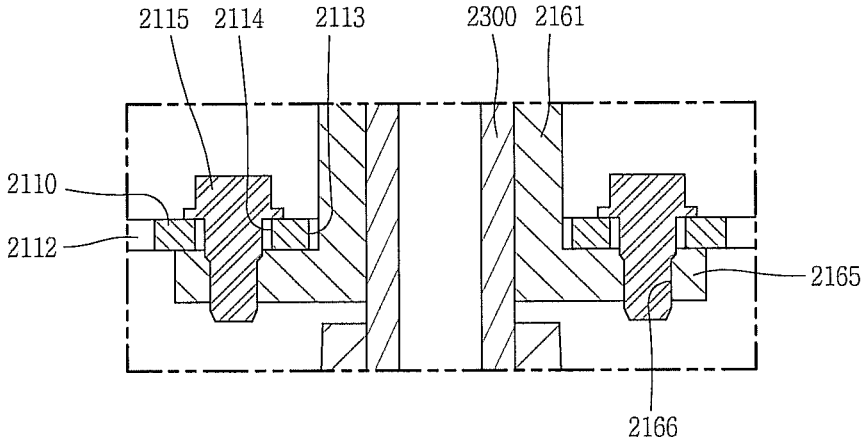
FIG. 17 is a cross-sectional view of an assembly structure of a stationary bush that controls concentricity with respect to a stationary shaft in the compressor of FIG. 16.

As illustrated in FIG. 17, the bush hole 2113 may be formed at or in the shell body shell 2110 to pass through the shaft receiving portion 2161 of the stationary bush 2160, and the through hole 2114 configured to fasten the stationary bush 2160 with the bolt 2115 may be formed adjacent to the bush hole 2113. Further, a fastening hole 2166 may be formed at a flange portion 2165 of the stationary bush 2160 to correspond to the through hole 2114.

An inner diameter of the bush hole 2113 may be larger than that of the shaft receiving portion 2161, while a diameter of the through hole 2114 may larger than that of the fastening hole 2166, thereby facilitating assembly based on a concentricity of the stationary shaft 2300. Further, the stator 2210 of the drive motor 2200 may be, for example, shrink-fitted and fixed to the shell body 2110, and the lower frame 2140, which supports a lower end of the stationary shaft 2300 while at the same time supporting the stator 2210, may be, for example, shrink-fitted and fixed to a lower end of the stator 2210. A discharge pipe 2103 that communicates with the internal space 2121 of the top shell 2120 to discharge compressed refrigerant to a cooling cycle apparatus may be coupled with a surface through which the suction pipe 2102 penetrates.

The accumulator 2500 may be coupled with the upper housing 2510 and the lower housing 2520 to be sealed to each other to form an accumulating chamber 2501, which may be separated from the internal space 2121 of the top shell 2120. A bush hole 2521 may be formed at a center of the lower housing 2520, and a sealing bush 2530 inserted into the stationary shaft 2300 may be fixed to the bush hole 2521.

Figure 18:
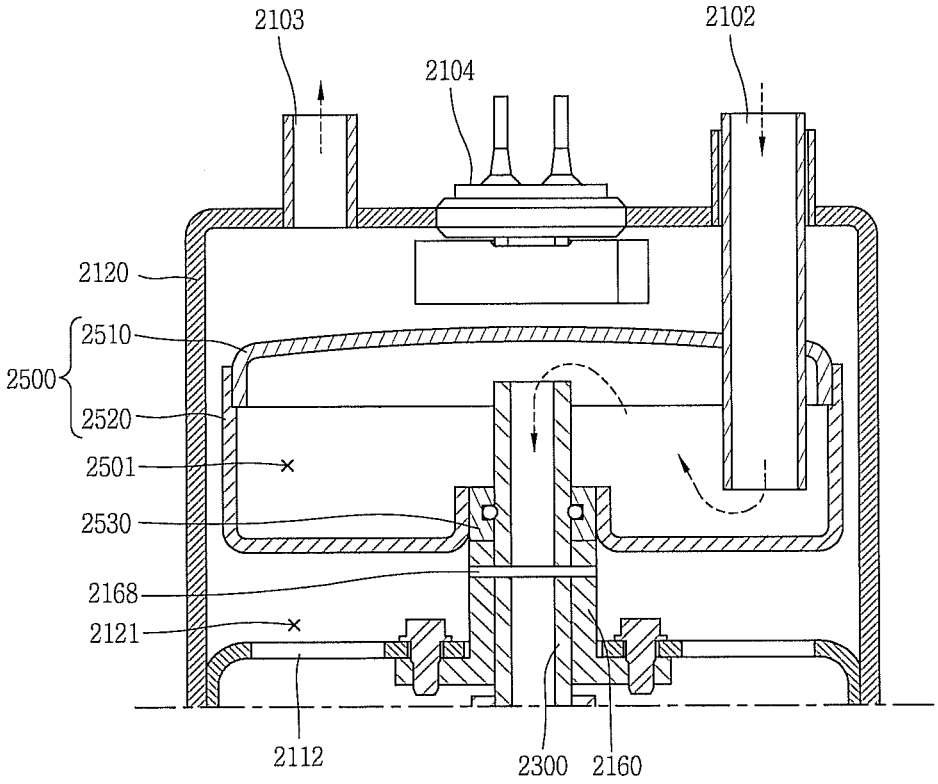
FIG. 18 is a cross-sectional view of an assembly position of a terminal in the compressor of FIG. 16, according to an embodiment.

A terminal mounting portion 2522 may be formed in a depressed manner, such that a terminal 2104 may be coupled with a side wall surface of the top shell 2120. The terminal 2104 may be installed at an upper surface of the top shell 2120, according to circumstances, as illustrated in FIG. 18. In this case, a separate terminal mounting portion may not be necessarily formed at a side wall surface of the accumulator 2500, and the sealing bush 2130 may be disposed to be accommodated into the accumulating chamber 2501 of the accumulator 2500, thereby preventing a height of the compressor from being increased due to the terminal 2104.

The other basic configuration and working effects thereof in a compressor according to this embodiment as described above may be substantially the same as the foregoing embodiment. However, according to this embodiment, as the accumulator 2500 is separated from the shell 2100, heat transferred through the shell 2100 may be prevented from being directly transferred to a suction refrigerant, and vibration due to a pulsating pressure generated when absorbing refrigerant may be prevented from being transferred to the shell.

In addition, the rotor 2220 and the cylinder 2410 including the stationary shaft 2300 may be located at an inner portion of the stator 2210 and the stationary bush 2160 fastened to the shell body 2110 based on a concentricity of the stationary shaft 2300, thereby facilitating assembly based on a concentricity between the stationary shaft 2300 and the stator 2210. Moreover, the suction pipe 2102, the discharge pipe 2103, and the terminal 2104 may be disposed on the same plane, thereby further reducing an area occupied by the compressor and further enhancing the design flexibility of the outdoor device.

Still another embodiment of a compressor will be described hereinbelow.

In other words, according to the foregoing embodiment, the accumulator may be installed to form an internal volume using a portion of the shell at an inner portion of the shell or may be separated from an inner circumferential surface of the shell by a predetermined distance to separately form an internal volume, but according to this embodiment, the accumulator may be installed to form an internal volume using the shell at an outer portion of the shell.

Figure 19:
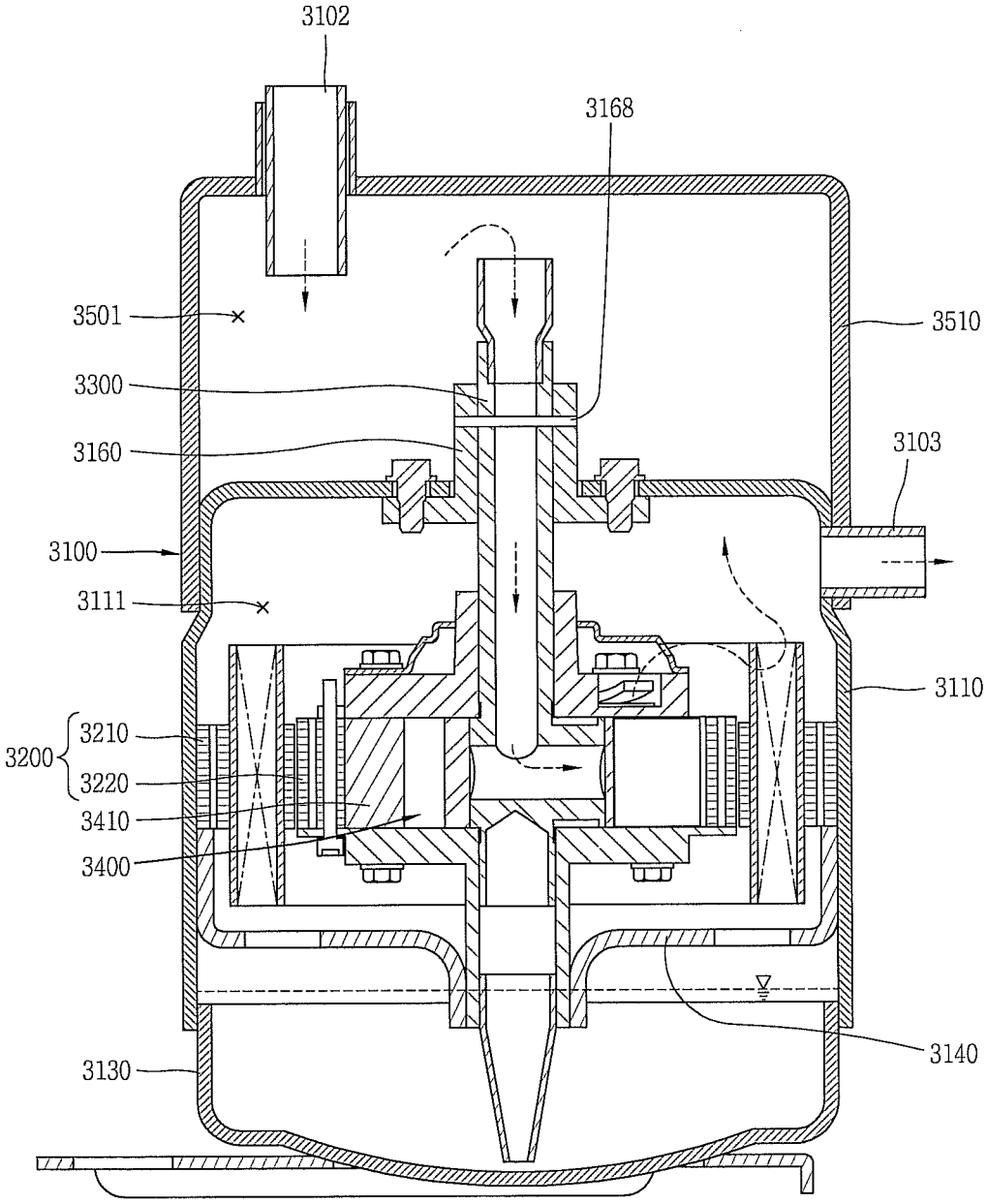
FIG. 19 is a cross-sectional view of compressor according to still another embodiment.

As illustrated in FIG. 19, according to this embodiment, the drive motor 3200 and the compression device 3400 may be installed in the shell body 3110, a lower end of which may be open to form part of the shell 3100, and a lower end of the shell body 3110 may be sealed by the lower cap 3130. Further, an accumulator shell 3510 may be coupled with an upper end of the shell body 3110 to form the accumulator 3500, and an upper surface of the shell body 3110 may be formed in a sealed shape to separate the internal space 3111 of the shell body 3110 from the accumulating chamber 3501 of the accumulator shell 3510. A stationary bush 3160 inserted and fixed by the stationary shaft 3300 may be fastened to a center of the shell body 3110, and the stationary shaft 3300 may be supported in an axial direction by, for example, a fixing pin 3168 that passes through the stationary shaft 3300 and the stationary bush 3160 in a radial direction. Further, a suction pipe 3102 may communicate and be coupled with an upper surface of the accumulator shell 3510, and a discharge pipe 3103 that discharges refrigerant discharged from the compression space of the compression device 3400 to a cooling cycle apparatus may communicate and be coupled with a radial directional surface of the shell body 3110.

The stator 3210 of the drive motor 3200 may be, for example, shrink-fitted and fixed to the shell body 3110, and the lower frame 3140, which supports a lower end of the stationary shaft 3300 while at the same time supporting the stator 3210, may be, for example, shrink-fitted and fixed to a lower end of the stator 3210.

The other basic configuration and working effects thereof in a compressor according to this embodiment as described above may be substantially the same as the foregoing embodiment. However, according to this embodiment, the accumulator shell 3510 forming the accumulator 3500 may be coupled with an outer surface of the shell body 3110 forming the shell to facilitate the assembly of the accumulator, and moreover, the rotor 3220 and the cylinder 3410 including the stationary shaft 3300 may be located at an inner portion of the stator 3210, and then, the stationary bush 3160 may be fastened to the shell body 3110 based on a concentricity of the stationary shaft 3300 to facilitate the assembly based on a concentricity between the stationary shaft 3300 and stator 3210.

In addition, a thickness of the accumulator shell 3510 forming the accumulator 3500 may be formed less than that of the shell body 3110 and the lower cap 3130, and a height of the shell 3100 having a relatively higher thickness may be decreased to reduce a weight of the entire compressor. Further, as the accumulator 3500 is installed at an outer portion of the shell 3100, refrigerant inhaled into the accumulating chamber 3501 of the accumulator 3500 may be quickly dissipated, thereby reducing a specific volume of the inhaled refrigerant and enhancing compressor performance.

Still another embodiment of a compressor will be described hereinbelow.

Figure 20:
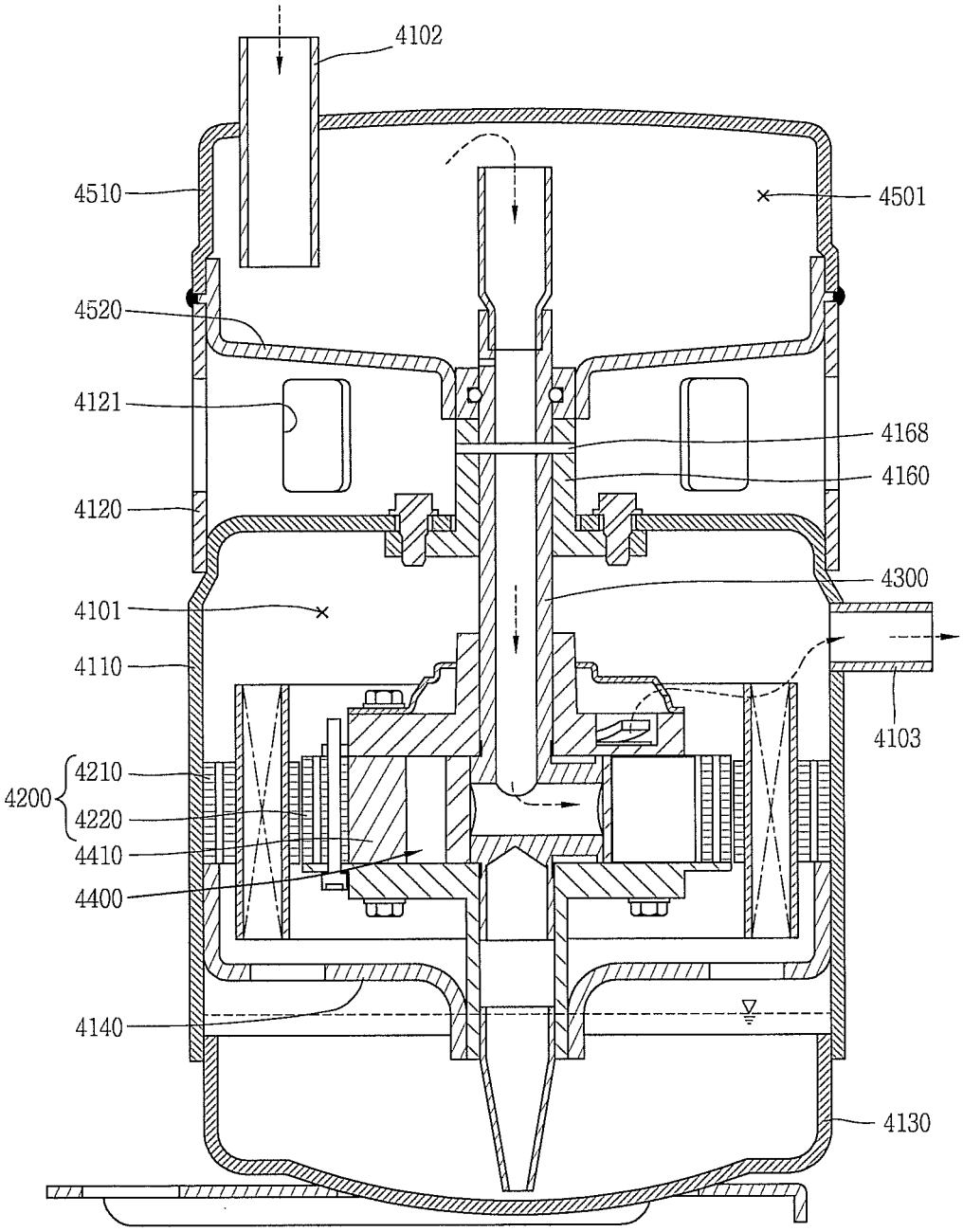
FIG. 20 is a cross-sectional view of a compressor according to still another embodiment.

In other words, according to the foregoing embodiment of FIG. 19, the accumulator may be formed at an outer portion of the shell using an outer surface of the shell to form an accumulating chamber, but according to this embodiment, the accumulator may be installed to have a predetermined distance at an outer portion of the shell. As illustrated in FIG. 20, according to this embodiment, the drive motor 4200 and the compression device 4400 may be installed in the shell body 4110, a lower end of which may be open to form part of the shell 4100, and a lower end of the shell body 4110 may be sealed by the lower cap 4130.

Further, an accumulator 4500 having a separate accumulating chamber 4501 may be disposed at an upper side of the shell body 4110 to have a predetermined distance, and an upper end of the stationary shaft 4300 may be coupled with the accumulator 4500. Furthermore, the accumulator 4500 may be coupled with an upper shell 4120, which may be inserted and coupled to an outer circumferential surface of the upper side of the shell body 4110. The upper shell 4120 may be formed in a cylindrical shape, such that both open ends thereof may be coupled with the shell body 4110 and accumulator 4500, respectively, for example, by welding. As an upper end of the shell body 4110 may be formed in a closed shape. A plurality of through holes 4121 may be formed to allow an internal space formed by the upper shell 4120 to communicate with the outside.

Furthermore, a stationary bush 4160 inserted and fixed by the stationary shaft 4300 may be fastened to a center of the shell body 4110, and the stationary shaft 4300 may be supported by, for example, a fixing pin 4168 that passes through the stationary shaft 4300 and the stationary bush 4160 in a radial direction.

The upper housing 4510 and the lower housing 4520 may be sealed to each other to form an accumulating chamber 4501 separated from the internal space 4101 of the shell 4100. Further, the suction pipe 4102 may communicate and be coupled with an upper surface of the accumulator 4500, and a discharge pipe 4103 that discharges refrigerant from the compression space of the compression device 4400 to a cooling cycle apparatus may communicate and be coupled with a radial directional surface of the shell body 4110. The suction pipe 4102 may not necessarily communicate with an upper surface of the accumulator 4500, but may also be installed to communicate in parallel with the discharge pipe 4103. In addition, the discharge pipe 4103 may not necessarily communicate with a side wall surface of the shell body 4110, but may also communicate with an upper surface of the shell body 4110.

The stator 4210 of the drive motor 4200 may be, for example, shrink-fitted and fixed to the shell body 4110, and the lower frame 4140, which may support a lower end of the stationary shaft 4300 while at the same time supporting the stator 4210, may be, for example, shrink-fitted and fixed to a lower end of the stator 4210.

The other basic configuration and working effects in a compressor according to the embodiment described above may be substantially the same as the foregoing embodiment. However, according to this embodiment, the accumulator 4500 may be installed to be separated from the shell body 4100 by a predetermined distance, thereby preventing heat generated by the shell body 4100 from being transferred to refrigerant being inhaled into an accumulating chamber of the accumulator 4500, and through this, a specific volume of the refrigerant being inhaled into a compression space of the compression device 4400 may be prevented from being increased, thereby enhancing compressor performance.

Embodiments disclosed herein provide a compressor in which an accumulating chamber of the accumulator may be formed using an internal space of the shell to reduce a size of the compressor including the accumulator, thereby reducing a size of an electrical product employing the compressor. Further, embodiments disclosed herein provide a compressor in which an assembly process of the accumulator and an assembly process of the shell may be unified to simplify an assembly process of the compressor, as well as reduce a number of connecting portions during assembly of the accumulator to prevent leakage of refrigerant from occurring.

Additionally, embodiments disclosed herein provide a compressor in which an area required to install the compressor in an outdoor device is minimized, as the compressor includes an accumulator, thereby enhancing design flexibility of the outdoor device. Further, embodiments disclosed herein provide a compressor in which a center of gravity of the accumulator is placed at a location corresponding to a center of gravity of the entire compressor including the accumulator, thereby reducing vibration noise of the compressor due to the accumulator.

Embodiments disclosed herein provide a compressor in which an eccentric portion is formed at a shaft thereof, while reducing vibration of the compressor and increasing an eccentric amount of the eccentric portion, thereby increasing compressor capacity.

Embodiments disclosed herein further provide a compressor in which even if an oil amount remaining at a bottom surface of the shell is lower than a sliding surface of a vane and vane slot, the oil may be efficiently supplied to the vane and vane slot to prevent malfunction of the vane from occurring, thereby suppressing compression loss.

Additionally, embodiments disclosed herein provide a compressor in which interference with other components is minimized when installing the compressor including an accumulator in an outdoor device, thereby allowing the compressor having a weight relatively higher than that of other components to be installed at a center of a gravity of the outdoor device.

Embodiments disclosed herein provide a compressor that may include a shell having a hermetic sealed internal space; a stator fixed and installed at an internal space of the shell; a rotor rotatably provided with respect to the stator to be rotated therewith; a cylinder combined with the rotor to be rotated therewith; a plurality of bearing plates that cover both sides of the cylinder to form a compression space therewith; a stationary shaft fixed to or in an internal space of the shell, a shaft a center of which is formed to correspond to a rotational center of the cylinder, and an eccentric portion of which is formed to vary a volume of the compression space during the rotation of the cylinder while supporting the bearing plates in an axial direction, and a refrigerant suction passage that guides refrigerant into the compression space; a rolling vane provided between the cylinder and the eccentric portion of the stationary shaft to be slid with respect to the eccentric portion while being rotated together with the cylinder; and an oil collecting plate installed at an upper side of the bearing plate located at an upper side of the plurality of bearing plates to collect oil.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a shell having a sealed internal space;

a stator fixed and installed in the internal space of the shell;

a rotor rotatably provided with respect to the stator to be rotated with the stator;

a cylinder coupled with the rotor to be rotated with the rotor, the cylinder having a rotational center, a top, and a bottom;

a plurality of bearings that cover the top and the bottom of the cylinder to form a compression space with the cylinder, the plurality of bearings including an upper bearing and a lower bearing;

a stationary shaft fixed in the internal space of the shell, a shaft center of the stationary shaft being coaxial to the rotational center of the cylinder, and an eccentric portion of the stationary shaft varying a volume of the compression space during rotation of the cylinder while supporting the plurality of bearings in an axial direction of the plurality of bearings;

a refrigerant suction passage that guides refrigerant into the compression space;

an accumulator having an accumulating chamber formed by an accumulator frame coupled to the shell, the accumulator frame being sealed with respect to the shell so that the accumulator frame air-tightly separates the accumulator chamber from the internal space of the shell, wherein a suction pipe communicates with the accumulating chamber, and wherein an end of the stationary shaft is inserted into and coupled with the accumulator, such that a suction passage of the stationary shaft communicates with the accumulating chamber; and an oil collecting plate installed on the upper bearing, located on the top of the cylinder, the oil collecting plate collecting oil and distributing it between the cylinder and the eccentric portion, wherein each of the plurality of bearings is formed with a shaft receiving portion having a shaft receiving hole configured to rotatably receive the stationary shaft inserted therein, and wherein the oil collecting plate comprises an oil collecting portion that surrounds an upper side of the shaft receiving portion and an oil guide portion that guides the collected oil to between the cylinder and the eccentric portions.

2. The compressor of claim 1, further comprising at least one oil groove formed at an inner circumferential surface of the shaft receiving hole, wherein an upper end of the at least one oil groove is open.

3. The compressor of claim 2, further comprising at least one oil through hole that penetrates the eccentric portion, wherein the at least one oil through hole communicates with the at least one oil groove.

4. The compressor of claim 2, further comprising an oil pocket in communication with the at least one oil through hole formed in at least one lateral surface of the eccentric portion in contact with one of the plurality of bearings.

5. The compressor of claim 1, further comprising an oil feeder provided at a lower end of the shaft receiving portion that pumps oil stored in the shell while being rotated together with one of the plurality of bearings.

6. The compressor of claim 1, wherein the accumulator frame is coupled with the shell to form the accumulating chamber together with an inner circumferential surface of the shell.

7. The compressor of claim 1, wherein the accumulator is coupled with the shell to form the accumulating chamber together with an outer circumferential surface of the shell.

8. A compressor, comprising:

a shell having a sealed internal space;

a stator fixed and installed in the internal space of the shell;

a rotor rotatably provided with respect to the stator to be rotated with the stator;

a cylinder coupled with the rotor to be rotated with the rotor, the cylinder having a rotational center, a top, and a bottom;

a plurality of bearings that cover the top and the bottom of the cylinder to form a compression space with the cylinder, the plurality of bearings including an upper bearing and a lower bearing, one of the upper bearing and the lower bearing having a discharge port that discharges refrigerant compressed in the compression space;

a stationary shaft fixed in the internal space of the shell, a shaft center of the stationary shaft being coaxial to the rotational center of the cylinder, and an eccentric portion of the stationary shaft varying a volume of the compression space during rotation of the cylinder while supporting the plurality of bearings in an axial direction of the plurality of bearings;

a refrigerant suction passage that guides refrigerant into the compression space;

a rolling vane provided between the cylinder and the eccentric portion of the stationary shaft, wherein the rolling vane is configured to slide with respect to the eccentric portion of the stationary shaft while being rotated together with the cylinder; and an oil collecting plate installed on the upper bearing, which is located on the top of the cylinder, the oil collecting plate collecting oil supplied by an oil feeder from a lower portion of the shell due to operation of the compressor, wherein each of the plurality of bearings is formed with a shaft receiving portion having a shaft receiving hole configured to rotatably receive the stationary shaft inserted therein, wherein the cylinder is formed with a vane slot configured to slidably receive the rolling vane inserted therein, wherein the oil collecting plate comprises an oil collecting portion that surrounds an upper side of the shaft receiving portion and an oil guide portion that communicates with the oil collecting portion and surrounds an upper side of the vane slot to guide the collected oil to the vane slot, wherein a noise space is formed in the oil collecting plate that accommodates refrigerant being discharged through the discharge port, wherein an oil guide hole that supplies oil to the vane slot is formed in the upper bearing, and wherein the oil guide hole communicates the noise space with the vane slot.

9. The compressor of claim 8, further comprising at least one oil groove formed at an inner circumferential surface of each shaft receiving hole, wherein an upper end of the at least one oil groove is open.

10. The compressor of claim 9, further comprising at least one oil through hole that penetrates the eccentric portion, wherein the at least one oil through hole communicates with the at least one oil groove.

11. The compressor of claim 9, further comprising an oil pocket in communication with the at least one oil through hole and formed in at least one surface of the eccentric portion in contact with one of the plurality of bearings.

12. The compressor of claim 8, further comprising the oil feeder provided at a lower end of the shaft receiving portion that pumps oil stored in the shell while being rotated together with one of the plurality of bearings.

13. The compressor of claim 8, further comprising an accumulator having an accumulating chamber formed by an accumulator frame coupled to the shell, the accumulator frame being sealed with respect to the shell so that the accumulator frame air-tightly separates the accumulator chamber from the internal space of the shell, wherein a suction pipe communicates with the accumulating chamber.

14. The compressor of claim 13, wherein an end of the stationary shaft is inserted into and coupled with the accumulator, such that the suction passage of the stationary shaft communicates with the accumulating chamber.

15. The compressor of claim 13, wherein the accumulator frame is coupled with the shell to form the accumulating chamber together with an inner circumferential surface of the shell.

16. The compressor of claim 13, wherein the accumulator is coupled with the shell to form an to form the accumulating chamber together with an outer circumferential surface of the shell.

* * * * *